US008875612B1

(12) United States Patent
Klett et al.

(10) Patent No.: US 8,875,612 B1
(45) **Date of Patent: *Nov. 4, 2014**

(54) SUPPRESSORS MADE FROM INTERMETALLIC MATERIALS

(71) Applicant: UT-Battelle, LLC, Oak Ridge, TN (US)

(72) Inventors: James W. Klett, Knoxville, TN (US); Thomas R. Muth, Knoxville, TN (US); Dan L. Cler, Coatesville, PA (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/987,354

(22) Filed: Jul. 16, 2013

Related U.S. Application Data

(63) Continuation-in-part of application No. 13/604,949, filed on Sep. 6, 2012.

(51) Int. Cl.
*F41A 21/30* (2006.01)
*C22C 19/03* (2006.01)
*F41A 21/34* (2006.01)

(52) U.S. Cl.
CPC ..... *F41A 21/30* (2013.01); *C22C 19/03* (2013.01); *F41A 21/34* (2013.01)
USPC ..... 89/14.4

(58) Field of Classification Search
USPC ..... 89/14.1, 14.2, 14.3, 14.4; 181/223
See application file for complete search history.

(56) References Cited

U.S. PATENT DOCUMENTS

| | | | | | |
|---|---|---|---|---|---|
| 1,081,348 | A | * | 12/1913 | Unke et al. | 181/264 |
| 1,174,165 | A | * | 3/1916 | Kenney | 89/14.3 |
| 1,427,802 | A | | 9/1922 | Goodwin | |
| 1,901,138 | A | | 3/1933 | Barnes | |
| 2,444,910 | A | * | 7/1948 | Barker | 89/14.3 |
| 2,514,996 | A | | 7/1950 | Faust | |
| 2,780,962 | A | * | 2/1957 | Ressler et al. | 89/14.2 |
| 3,368,453 | A | | 2/1968 | Shaw | |
| 3,455,203 | A | * | 7/1969 | Pillersdorf | 89/14.3 |
| 3,483,794 | A | * | 12/1969 | Packard | 89/14.2 |
| 3,528,336 | A | * | 9/1970 | Donner | 89/14.3 |
| 3,545,179 | A | | 12/1970 | Nelson et al. | |
| 3,951,039 | A | * | 4/1976 | Manninen et al. | 89/14.3 |
| 4,291,610 | A | * | 9/1981 | Waiser | 89/14.4 |
| 5,029,512 | A | | 7/1991 | Latka | |
| 5,108,700 | A | | 4/1992 | Liu | |
| 5,136,923 | A | * | 8/1992 | Walsh, Jr. | 89/14.2 |

(Continued)

OTHER PUBLICATIONS

Ed Kubel, "Intermetallics Solve Manufacturing Challenges," IndustrialHeating.com, 2005, pp. 81-84.

(Continued)

*Primary Examiner* — Bret Hayes
(74) *Attorney, Agent, or Firm* — Colin L. Cini

(57) ABSTRACT

Disclosed are several examples of apparatuses for suppressing the blast and flash produced as a projectile is expelled by gases from a firearm. In some examples, gases are diverted away from the central chamber to an expansion chamber by baffles. The gases are absorbed by the expansion chamber and desorbed slowly, thus decreasing pressure and increasing residence time of the gases. In other examples, the gases impinge against a plurality of rods before expanding through passages between the rods to decrease the pressure and increase the residence time of the gases. These and other exemplary suppressors are made from an intermetallic material composition for enhanced strength and oxidation resistance at high operational temperatures.

8 Claims, 23 Drawing Sheets

(56) References Cited

U.S. PATENT DOCUMENTS

| | | | | |
|---|---|---|---|---|
| 5,164,535 | A * | 11/1992 | Leasure | 89/14.4 |
| 5,413,189 | A | 5/1995 | Browning et al. | |
| 5,659,158 | A | 8/1997 | Browning et al. | |
| 5,892,186 | A | 4/1999 | Flugger | |
| 6,238,620 | B1 | 5/2001 | Liu et al. | |
| 6,298,764 | B1 * | 10/2001 | Sherman et al. | 89/14.2 |
| 6,308,609 | B1 * | 10/2001 | Davies | 89/14.4 |
| 6,575,074 | B1 * | 6/2003 | Gaddini | 89/14.4 |
| 7,207,258 | B1 | 4/2007 | Scanlon | |
| 7,412,917 | B2 | 8/2008 | Vais | |
| 7,581,482 | B1 | 9/2009 | Cler et al. | |
| 7,600,461 | B1 | 10/2009 | Cler et al. | |
| 7,861,636 | B1 | 1/2011 | Hoffman | |
| 7,874,238 | B2 | 1/2011 | Silvers | |
| 2005/0126382 | A1 * | 6/2005 | Yoshimura et al. | 89/14.4 |
| 2005/0262997 | A1 * | 12/2005 | Brixius | 89/14.1 |
| 2006/0093851 | A1 * | 5/2006 | Darolia et al. | 428/680 |
| 2007/0107590 | A1 | 5/2007 | Silvers | |
| 2008/0148928 | A1 * | 6/2008 | McClellan | 89/14.4 |
| 2009/0084255 | A1 * | 4/2009 | Carter et al. | 89/14.7 |
| 2010/0180759 | A1 * | 7/2010 | Petersen | 89/14.4 |
| 2010/0236122 | A1 * | 9/2010 | Fonte | 42/76.1 |
| 2012/0048100 | A1 * | 3/2012 | Davies | 89/14.2 |
| 2012/0152093 | A1 * | 6/2012 | Koumbis | 89/14.4 |

OTHER PUBLICATIONS

Dr. Vinod K. Sikka, "Advanced Materials Intermetallics for Manufacturing," U.S. Department of Energy, Efficiency and Renewable Energy, 2005.

* cited by examiner

SUPPRESSORS MADE FROM INTERMETALLIC MATERIALS

CROSS-REFERENCE TO RELATED APPLICATIONS

This application is a continuation-in-part of U.S. application Ser. No. 13/604,949 filed on 6 Sep. 2012 and entitled, "A Suppressor for Reducing the Muzzle Blast and Flash from a Firearm", which claims the benefit of priority to U.S. Provisional Application Ser. No. 61/535,574, filed 16 Sep. 2011.

STATEMENT REGARDING FEDERALLY SPONSORED RESEARCH AND DEVELOPMENT

This invention was made with government support under Contract No. DE-AC05-000822725 awarded by the U.S. Department of Energy. The government has certain rights in the invention.

THE NAMES OF THE PARTIES TO A JOINT RESEARCH AGREEMENT

None.

BACKGROUND OF THE INVENTION

1. Field of the Invention

The present disclosure relates to firearms and more specifically to a suppressor that reduces the audible blast and visual flash generated as a projectile is fired from a firearm. The suppressor is made of an intermetallic material composition for enhanced strength and oxidation resistance at high operational temperatures.

2. Description of the Related Art

Firearms such as rifles, shotguns, pistols, and revolvers with integral or removable barrels function by discharging a projectile, such as a bullet, at a target. In each type of firearm, a cartridge or round is first loaded, manually or automatically, into a proximal chamber at a breech end of the barrel. Then, a firing pin strikes a primer located in the base of the cartridge casing, igniting an explosive propellant that produces highly pressurized gases to propel a projectile or bullet out of the cartridge casing. The bullet then travels within a central, longitudinal bore of the barrel and exits out a distal end called a muzzle. A series of rifling lands and grooves in the barrel introduce a twist to the bullet as it travels through the bore, stabilizing it in flight, for improved accuracy.

As the bullet exits the muzzle, the highly pressurized gases quickly expand into the relatively low-pressure atmosphere, producing an audible, muzzle blast and a visual, muzzle flash. During both Military and Law Enforcement operations it is advantageous to suppress the muzzle flash from potential adversaries in order to conceal a shooter's position and gain a tactical advantage. This is especially true during clandestine operations, carried out under the veil of darkness, such as when the elite U.S. Navy Seal Team 6 killed Osama Bin Laden in his Pakistani compound in 2011. During Military, Law Enforcement and Competitive Shooting operations it is also beneficial to reduce the muzzle blast in order to safeguard the shooter from temporary or permanent hearing loss.

Most Military and Law Enforcement assault style rifles have relatively short barrel lengths for reduced weight, enhanced maneuverability, and improved target acquisition in hostile environments. However, when using these shorter barrels, the propellant charge is still burning as the bullet exits the muzzle, causing the muzzle flash to be significantly greater than it would be with longer barrels. Since a longer barrel decreases maneuverability and increases weight, various means of reducing muzzle blast and flash of shorter barrels have been devised.

Firearms are known to incorporate muzzle blast suppressors and/or flash suppressors. Blast suppressors are typically designed to reduce the pressure of the gases prior to discharging into the atmosphere. One such example of a blast suppressor is disclosed in U.S. Pat. No. 7,207,258 "WEAPON SILENCERS AND RELATED SYSTEMS." Flash suppressors are typically designed to reduce the muzzle flash from the firearm to preserve the shooter's night vision, usually by directing the incandescent gases to the sides, away from the line of sight of the shooter, and to reduce the flash visible to the enemy. Military forces engaging in night combat are still visible when firing by the enemy, especially if they are wearing night vision gear, and must move quickly after firing to avoid receiving return fire. One such example of a flash suppressor is disclosed in U.S. Pat. No. 7,861,636 "MUZZLE FLASH SUPPRESSOR." Blast and flash suppressors are typically affixed to a firearm barrel at the muzzle end via a threaded connection.

Suppressors capture and manage the high pressure and high temperature gasses exiting a barrel. The high temperatures soften the material and the high pressures can then cause the suppressor to fail.

Despite the teachings provided by the prior art, further improvements to muzzle flash and muzzle blast suppressors are needed to advance the state of the art and improve the survivability of law enforcement and armed forces personnel.

BRIEF SUMMARY OF THE INVENTION

Disclosed are several examples of apparatuses for suppressing the blast and flash produced as a projectile is expelled by gases from a firearm. The apparatuses are made of an intermetallic material.

According to one example, an apparatus for suppressing the blast and flash from a firearm includes a body made of an intermetallic material composition having a proximal end located adjacent to the firearm and an opposite, distal end. The body has a wall made of an intermetallic material composition with an inner surface that defines a central chamber and an outer surface that defines an inner boundary of an enclosed gas expansion chamber. The wall also defines a gas-transfer port for fluidly connecting the central chamber with the gas expansion chamber. A baffle made of an intermetallic material composition is disposed within the central chamber of the body and is proximate a gas-transfer port. The baffle has a diffuser-shaped surface for diverting the gases from the central chamber and into a gas-transfer port. A can made of an intermetallic material composition is disposed around and spaced apart from the body wall. The can has a wall with an outer surface that is exposed to the ambient atmosphere, and an inner surface that defines an outer boundary of the gas expansion chamber such that the body wall outer surface and the can wall inner surface cooperate to define the enclosed gas expansion chamber. A rib made of an intermetallic material composition extends between the body wall outer surface and the can wall inner surface, with the rib further defining the gas expansion chamber. In this example, the gases are directed between the central chamber and the expansion chamber via a gas-transfer port as the projectile moves from the proximal end to the distal end.

According to another example, an apparatus for suppressing the blast and flash produced by a projectile as it is expelled by gases from a firearm includes a body made of an intermetallic material composition having a proximal end located adjacent to the firearm and an opposite, distal end. The body has a plurality of spaced apart rods extending between the proximal and distal ends with the rods defining a central chamber. In this example, the gases are directed from the central chamber and through the spaces between the rods as the projectile moves from the proximal end to the distal end.

BRIEF DESCRIPTION OF THE SEVERAL VIEWS OF THE DRAWINGS

A more complete understanding of the preferred embodiments will be more readily understood by reference to the following detailed description when considered in conjunction with the accompanying drawings where like numerals indicate common elements among the various figures.

DETAILED DESCRIPTION OF THE INVENTION

Suppressors in accordance with examples of the present invention will now be described in greater detail. Computer models of these examples were first generated using a Computer Aided Design (CAD) program before being analyzed with Computational Fluid Dynamics (CFD). The CFD results were examined and each suppressor's geometry was optimized to increase residence time and to reduce the mach number of the gases exiting the suppressor. Please note that various types of firearms are known to have different barrel lengths, use different cartridge loads, and operate at different gas pressures. For this reason, parametric manipulation of some of the claimed elements may be necessary to ensure a suppressor design is optimized for each specific application.

Figure 1:
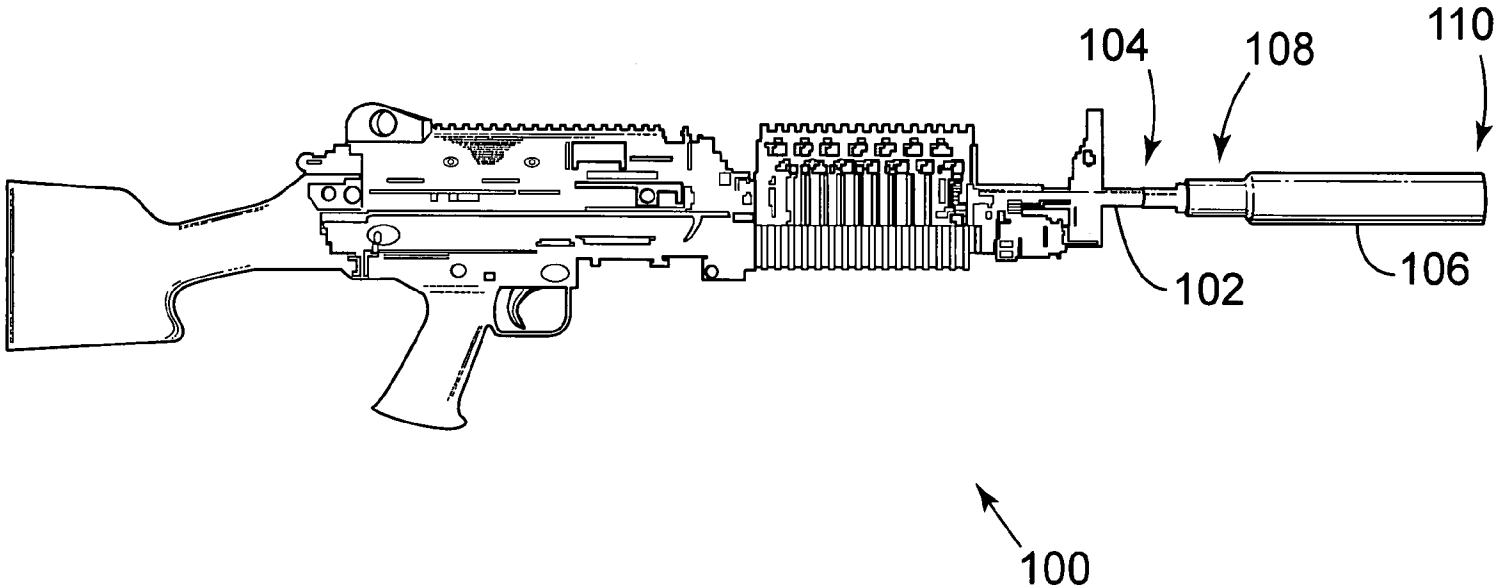
FIG. 1 is a side view of a rifle with a suppressor installed in accordance with an example of the present invention.
Figure 2:
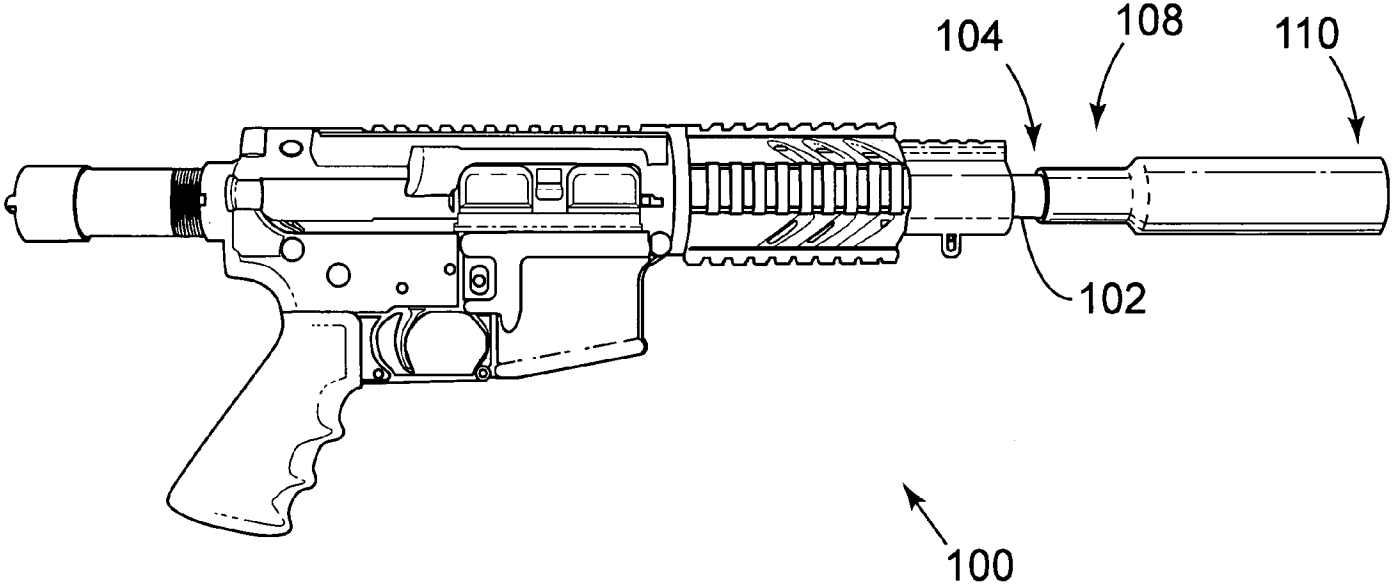
FIG. 2 is a side view of a pistol with a suppressor installed in accordance with an example of the present invention.

Referring first to FIGS. 1 and 2, a firearm 100 includes a barrel 102 for discharging a projectile at an intended target. Affixed to a muzzle end 104 of the barrel 102 is a suppressor 106 in accordance with an example of the present invention. The suppressor 106 has a proximal end 108 for affixing to the firearm 100 and an opposite distal end 110 where the projectile exits the suppressor 106. The firearms 100 illustrated in FIGS. 1 and 2 are exemplary and are not to be considered exhaustive in any way. Many firearm architectures have existed in the past, currently exist today, or will exist in the future. It is to be understood that all types of firearms 100 will benefit from the exemplary suppressors 106 of the present invention.

Exemplary suppressors 106 will now be described in more detail with reference to FIGS. 3-5. A body 112 has the proximal end 108 having attachment means 114 for affixing the suppressor 106 to the muzzle end 104 of a barrel 102. The attachment means 114 may be internally machined threads (shown), a cam-lock fastener, a clamp, a set screw, or some other attachment means 114 known in the art. The distal end 110 is located opposite of the proximal end 108 and closest to the intended target. A body wall 116 has an inner surface 118 that defines a central chamber 120, while an outer surface 122 of the body wall 116 defines an inner boundary of an enclosed gas expansion chamber 124. The body wall 116 also defines a gas-transfer port 126 for fluidly connecting the central chamber 120 with the gas expansion chamber 124. The body 120 is preferably manufactured from an intermetallic material composition by casting, machining and welding, and will be described in greater detail later. The body 120 can also be manufactured by a direct to metal (DTM) 3D printing process (preferred), investment casting, conventional machining, sheet stamping and welding, or other suitable manufacturing methods. Titanium, Aluminum, Nickel, INCONEL alloy, or other light-weight, high-strength materials may be used.

Figure 6:
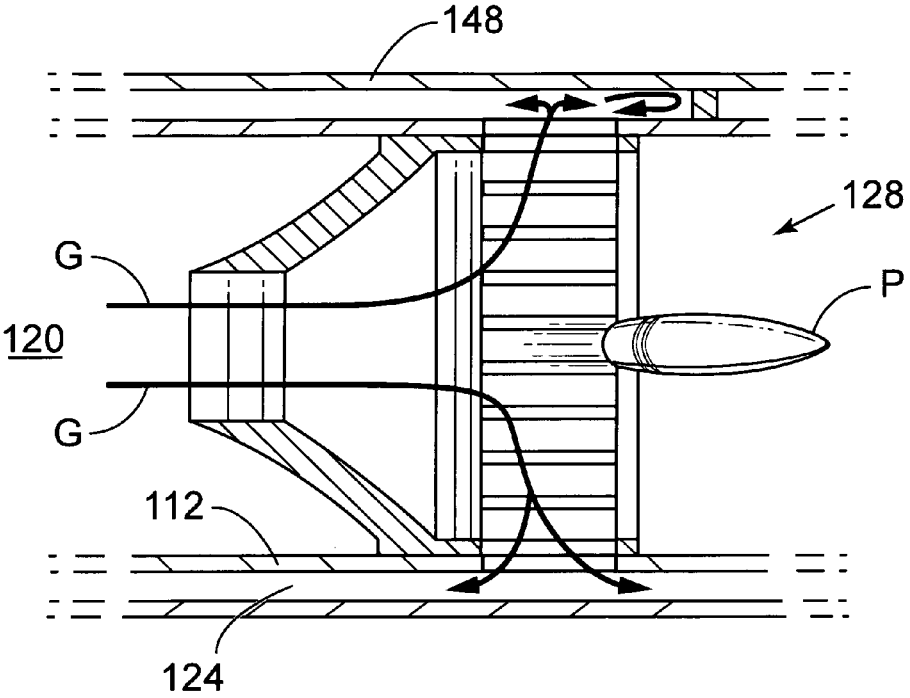
FIG. 6 is a partial sectional side view of an exemplary baffle.
Figure 7:
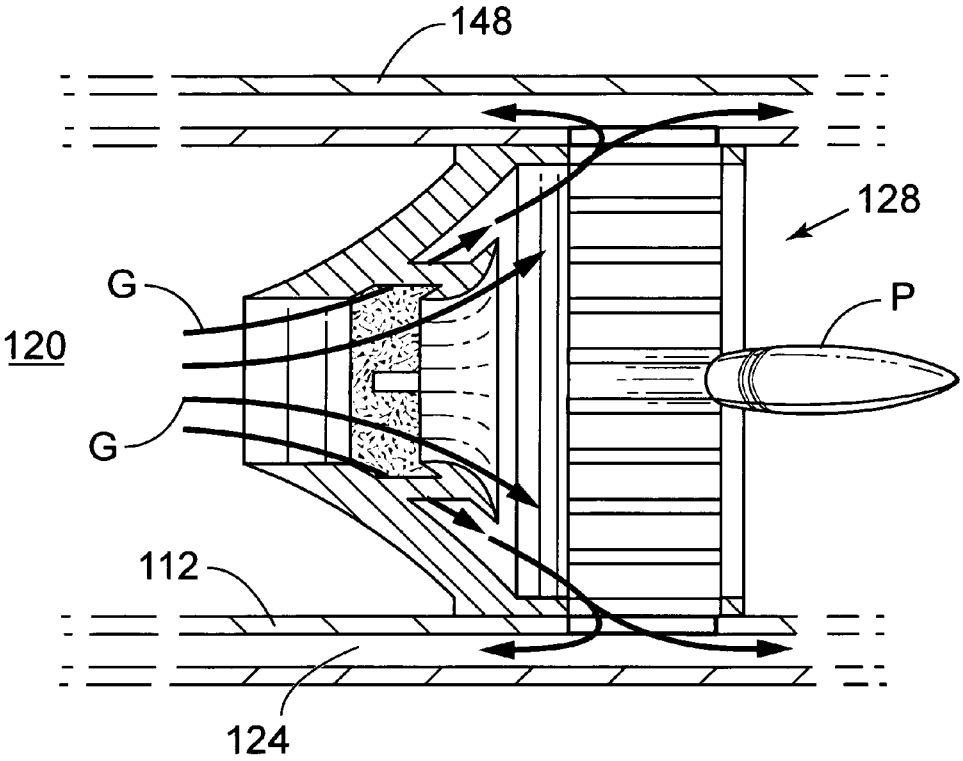
FIG. 7 is a partial sectional side view of another exemplary baffle.
Figure 8:
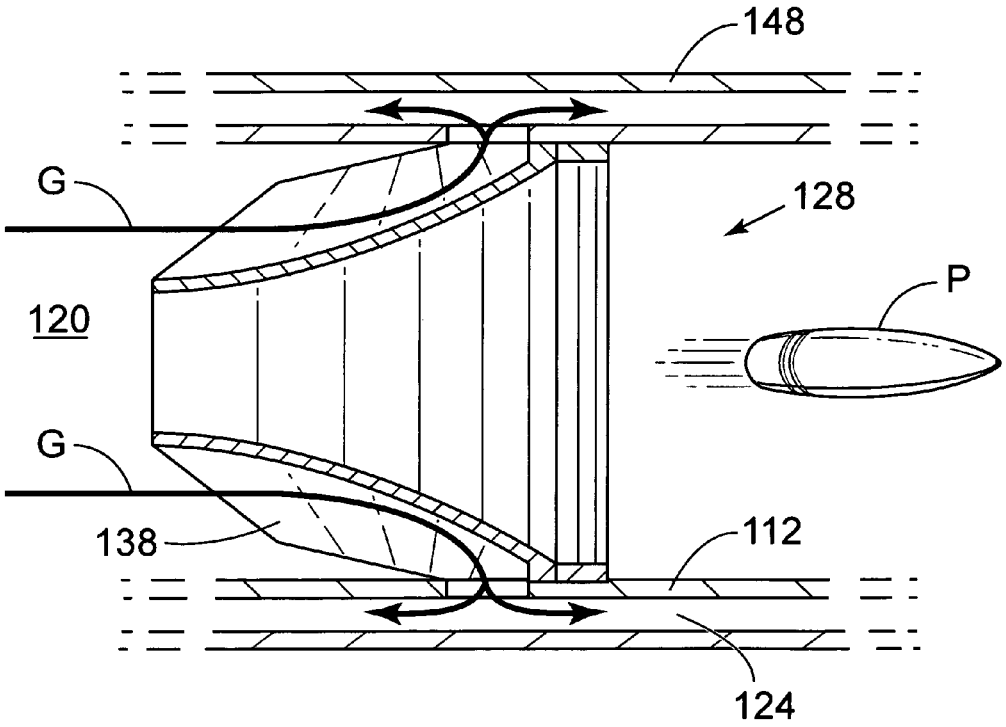
FIG. 8 is a partial sectional side view of yet another exemplary baffle.
Figure 9:
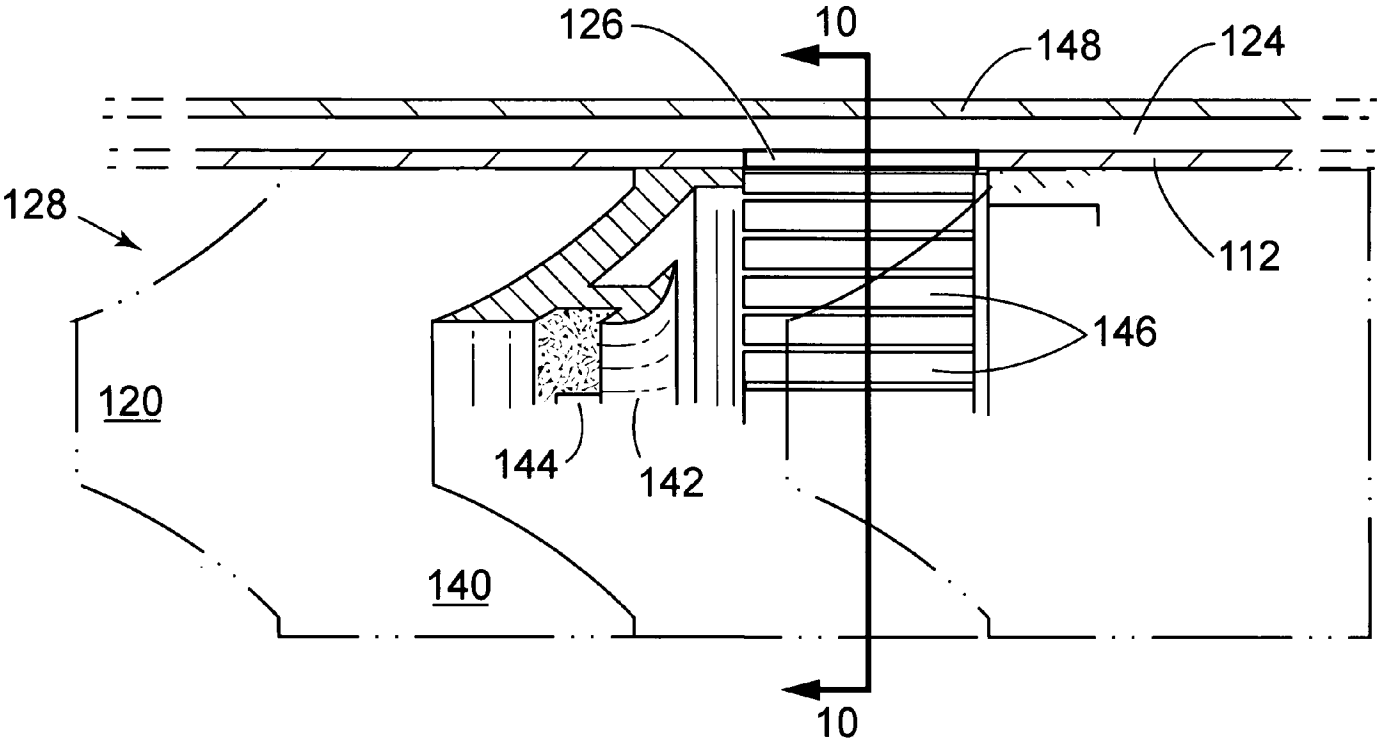
FIG. 9 is a partial sectional side view of the exemplary baffle of FIG. 7 illustrated in relation to adjacent exemplary baffles shown in phantom.
Figure 10:
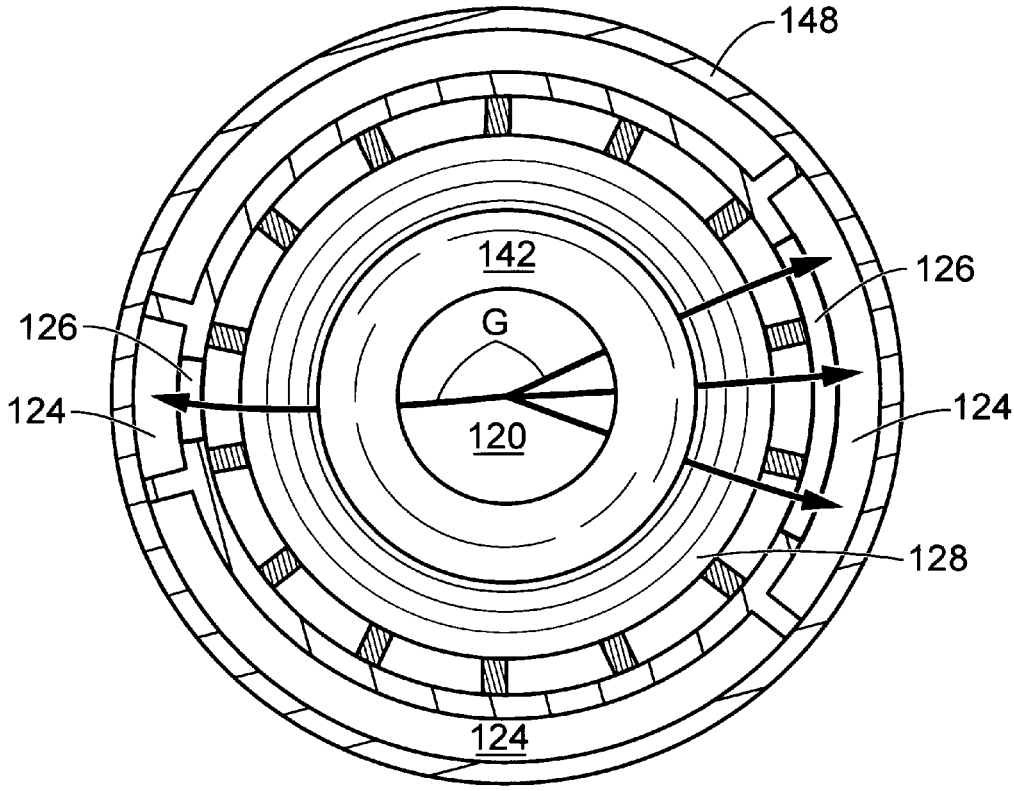
FIG. 10 is a sectional front view of the exemplary baffle of FIG. 9 taken along line 10-10.
Figure 12:
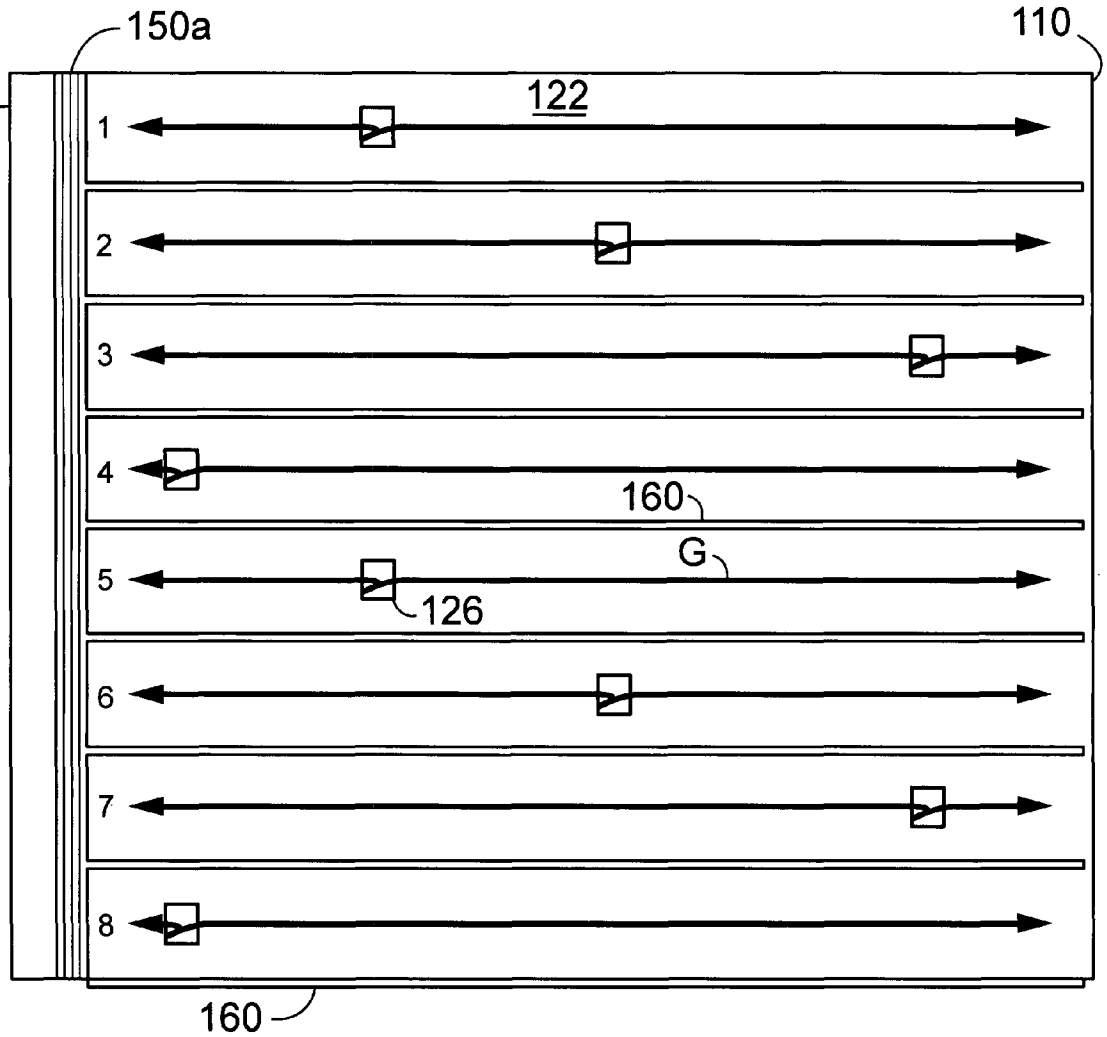
FIG. 12 is an unfolded view of the exemplary body of FIG. 11.
Figure 11:
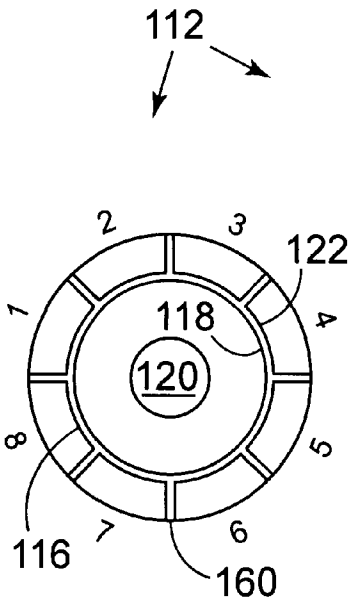
FIG. 11 is a front view of an exemplary body of a suppressor.

A baffle 128 is disposed within the central chamber 120 of the body 112 and adjacent to a gas transfer port 126. FIGS. 6-10 illustrate several examples of these baffles 128. Each baffle 128 includes: an upstream, diffuser-shaped surface 130 for diverting the gases (G) from the central chamber 120 to the expansion chamber 124; and a downstream, diffuser-shaped surface 132 for further diverting the gases (G) from the central chamber 120 to the expansion chamber 124. Some exemplary baffles 128 include a cylindrical-shaped inlet 134, a cage 136, and a series of ribs 138. The cage 136 and ribs 138 center the baffles 128 within the body 112 and properly align the baffles 128 with respect to each other and with respect to the gas transfer ports 126. Adjacent baffles 128 define an annular chamber 140, best illustrated in FIG. 9, where the gases (G) are diverted into as the projectile (P) passes through the baffle 128. In the examples of FIGS. 7 and 9, a circular airfoil 142 extends from the downstream diffuser-shaped surface 132 by a strut 144. The airfoil 142 further defines the annular chamber 140 and further diverts the gases (G) from the central chamber 120 to the gas transfer port 126. With the baffles 128 assembled in the body 112, a plurality of windows 146 in the cage 136 substantially align with the gas transfer ports 126 as shown in the examples of FIGS. 6-7. Also, please note that a separate or integral sleeve 147 may also be used to properly space a baffle 128 from the proximal end 108 of the body 112. The baffles 128 and sleeve 147 are preferably manufactured from an intermetallic material composition by casting, machining, and welding, and will be described in greater detail later. The baffles 128 and sleeve 147 can also be manufactured by a direct to metal (DTM) 3D printing process, investment casting, conventional machining, or other suitable manufacturing methods. Titanium, Aluminum, Nickel, INCONEL alloy, or other light-weight, high-strength materials may be used.

Figure 5:
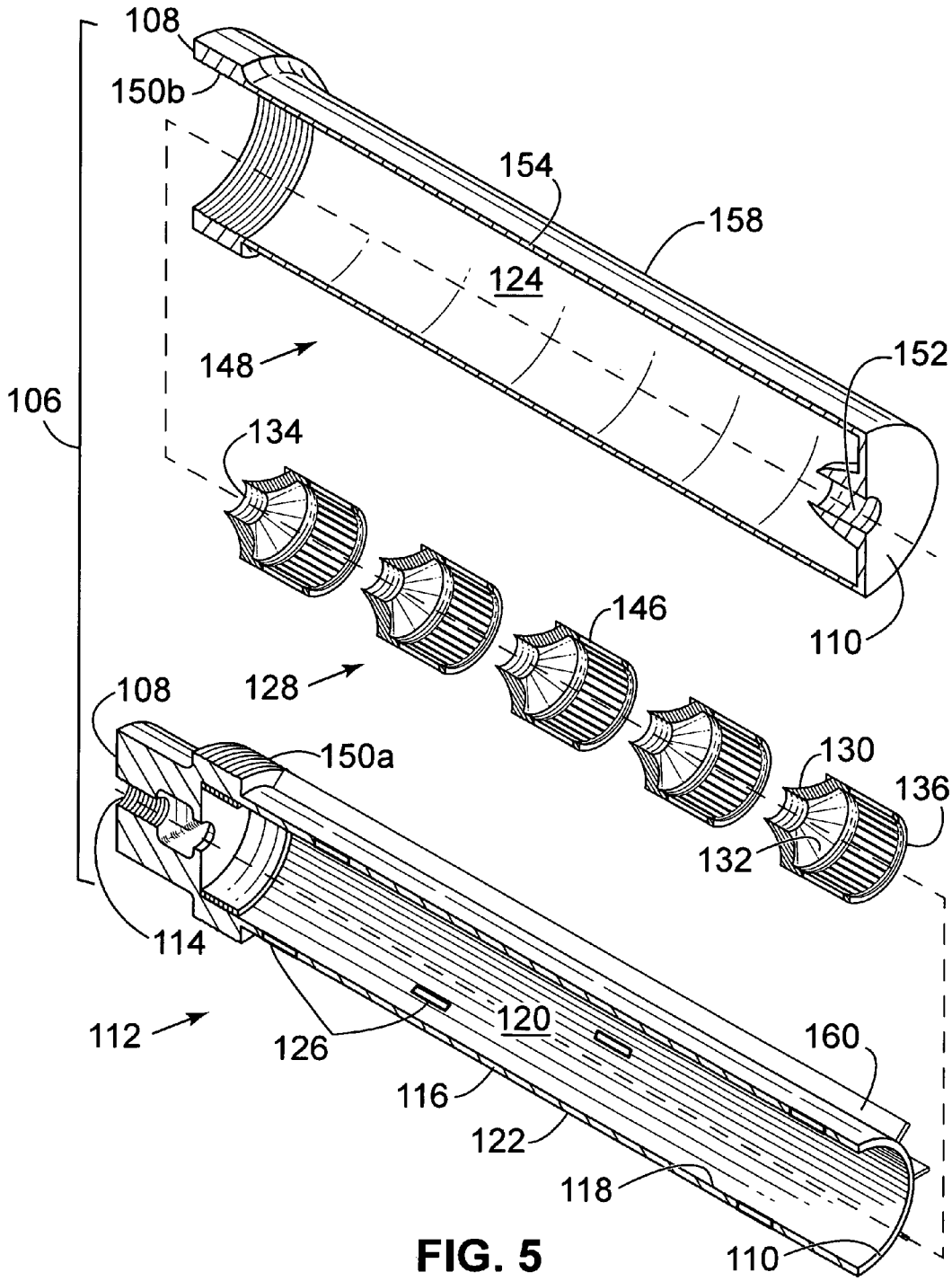
FIG. 5 is an exploded view of the suppressor of FIG. 4.

A can 148 is disposed around the body 112 as best shown in FIG. 5. The proximal end 108 of the can 148 is affixed to the proximal end 108 of the body 112 by a two-part attachment means (150*a*, 150*b*) on the body 120, and the can 148 respectively. The attachment means (150*a*, 150*b*) allow for disassembly of the suppressor 106 for inspection, cleaning or part replacement and may include coordinating threads (shown), a cam-lock fastener, a screw clamp, a set screw, or some other suitable attachment means. In other examples, the can 148 is permanently affixed to the body 112 by welding or some other permanent means (not shown). A distal end 110 of the can 148 includes a cylindrical port 152 for straightening the discharged gases (G) to improve the trajectory of the projectile (P) as it exits the suppressor 106. The can 148 is formed by a wall 154 that includes: an inner surface 156 that defines an outer boundary of the enclosed gas expansion chamber 124; and an outer surface 158 that is exposed to the ambient atmosphere (A). Carefully note that when the suppressor 106 is assembled, the outer surface 122 of the body wall 116 and the inner surface 156 of the can wall 154 cooperate to define the enclosed gas expansion chamber 124. The can 148 may also include an aperture (not shown) through the wall 154, at the distal end 110, for allowing water to drain out if the suppressor 106 is submerged. The can 148 is preferably manufactured from an intermetallic material composition by casting, machining, and welding, and will be described in greater detail later. The can 148 can also be manufactured By a direct to metal (DTM) 3D printing process, investment casting, spinning, roll forming and welding, or other suitable manufacturing methods. Titanium, Aluminum, Nickel, INCONEL alloy, or other light-weight, high-strength materials may be used.

One or more ribs 160 extend between the outer surface 122 of the body wall 116 and the inner surface 156 of the can wall 154. In some examples, a rib 160 is attached to, and extends from, the outer surface 122 of the body wall 116. This configuration is preferred for manufacturing simplicity. In other examples, a rib 160 is attached to, and extends from, the inner surface 156 of the can wall 154. According to one example, a rib 160 may extend, lengthwise, from the proximal end 108 to the distal end 110 of the body 112. According to another example, a rib 160 may extend around the body 112 at a constant distance from each of the proximal end 108 and distal end 110 of the body 112. According to yet another example, a rib 160 may extend at a variable distance from each of the proximal 108 and distal ends 110 of the body 112 in a spiral arrangement. In yet another example, a rib 160 is disposed on each side of a gas transfer port 126. In yet another example, a rib 160 is interposed between each of a plurality of gas-transfer ports 126. In each of the preceding examples, the one or more ribs 160 further define the volume, shape, pattern and direction of the enclosed, gas expansion chamber 124. The one or more ribs 160 are preferably manufactured from an intermetallic material composition by casting, machining, and welding, and will be described in greater detail later.

Referring now to FIGS. 11-20, several, non-exhaustive, examples of a suppressor body 112 are shown. Please note that some of the views are unfolded to best illustrate the relationships between the various features located about the body 112. The unfolded views are in no way indicative of the manufacturing methods used to make a body 112. In the specific example shown in FIGS. 11-12, eight ribs 160 are interposed between eight, square-shaped, gas-transfer ports 126. Note that pairs of the gas transfer ports 126 are symmetrically opposite one another at a constant distance from the proximal end 108 and the pairs vary circumferentially about the body 112 going towards the distal end 110. Here, a rib 160 extends the full distance from the proximal end 108 to the distal end 110 of the body 112.

Figure 14:
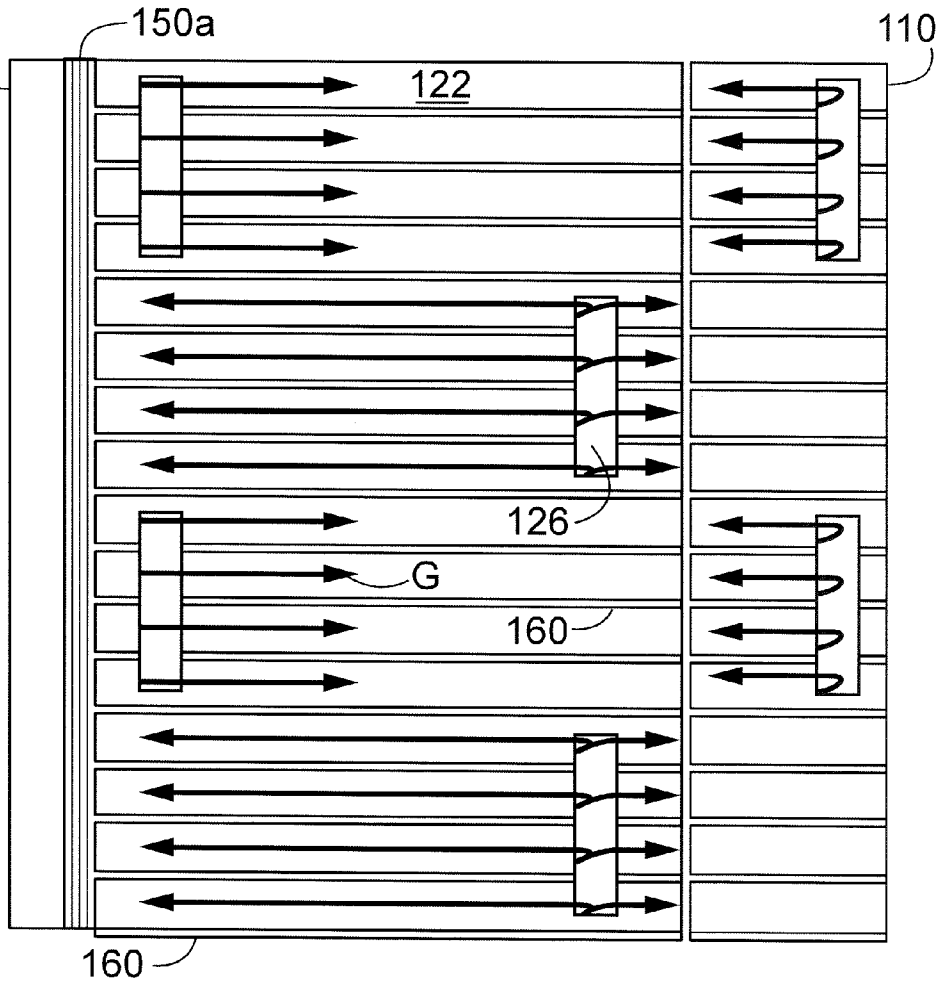
FIG. 14 is an unfolded view of the exemplary body of FIG. 13.
Figure 13:
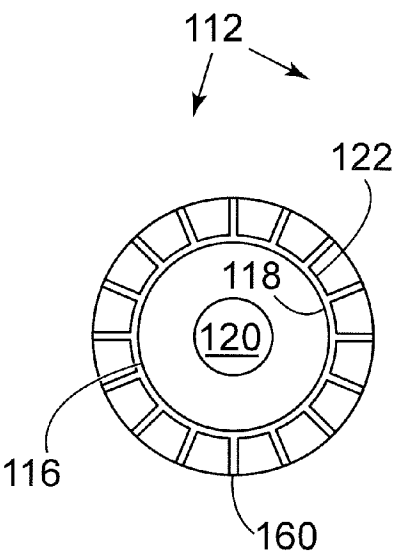
FIG. 13 is a front view of another exemplary body of a suppressor.

In the specific example of FIGS. 13-14, sixteen ribs 160 are interposed among six, rectangular-shaped, gas-transfer ports 126. One rib 160*a* is disposed at a constant distance from each of the proximal and distal ends (108, 110) of the body 112. Note that pairs of the gas transfer ports 126 are symmetrically opposite one another and at a constant distance from the proximal end 108 and some of the pairs vary circumferentially about the body 112 going towards the distal end 110. Also, please note that the gas-transfer ports 126 of this example extend across more than one of the ribs 160. In this example, there may, or may not be, a one-to-one correspondence between the gas-transfer port 126 size and the baffle window size 146. The baffle window 146 area may be larger than, equal to, or smaller than the corresponding gas-transfer port 126 area.

Figure 16:
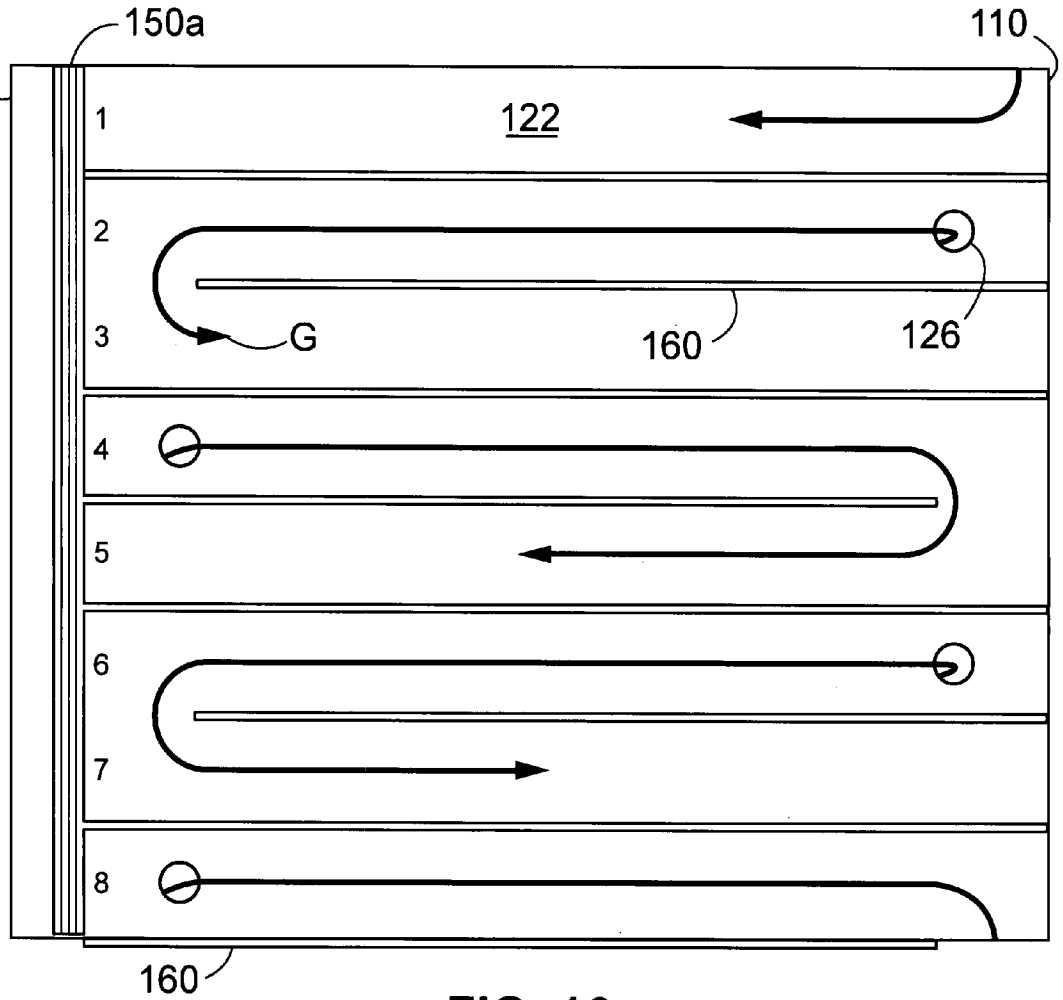
FIG. 16 is an unfolded view of the exemplary body of FIG. 15.
Figure 15:
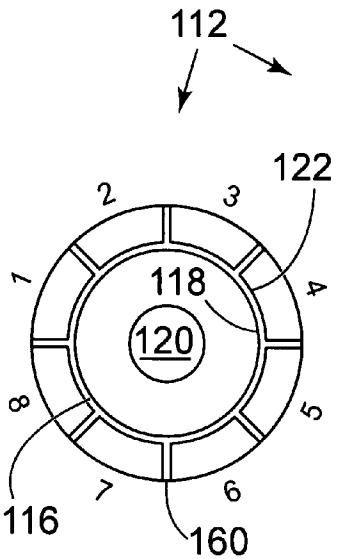
FIG. 15 is a front view of yet another exemplary body of a suppressor.

In the specific example of FIGS. 15-16, eight ribs 160 are interposed among four, round-shaped, gas-transfer ports 126. Note that pairs of the gas transfer ports are symmetrically opposite one another and at a constant distance from the proximal end 108 and the pairs vary circumferentially about the body 112 going towards the distal end 110. Also, please note that some of the ribs don't extend the full distance from the proximal to the distal ends (108, 110), creating a serpentine-shaped expansion chamber 124. Note that the serpentine shapes of the expansion chamber 124 causes the gases (G) to reverse direction and travel the length of the body 112 twice, thus increasing the residence time.

Figure 18:
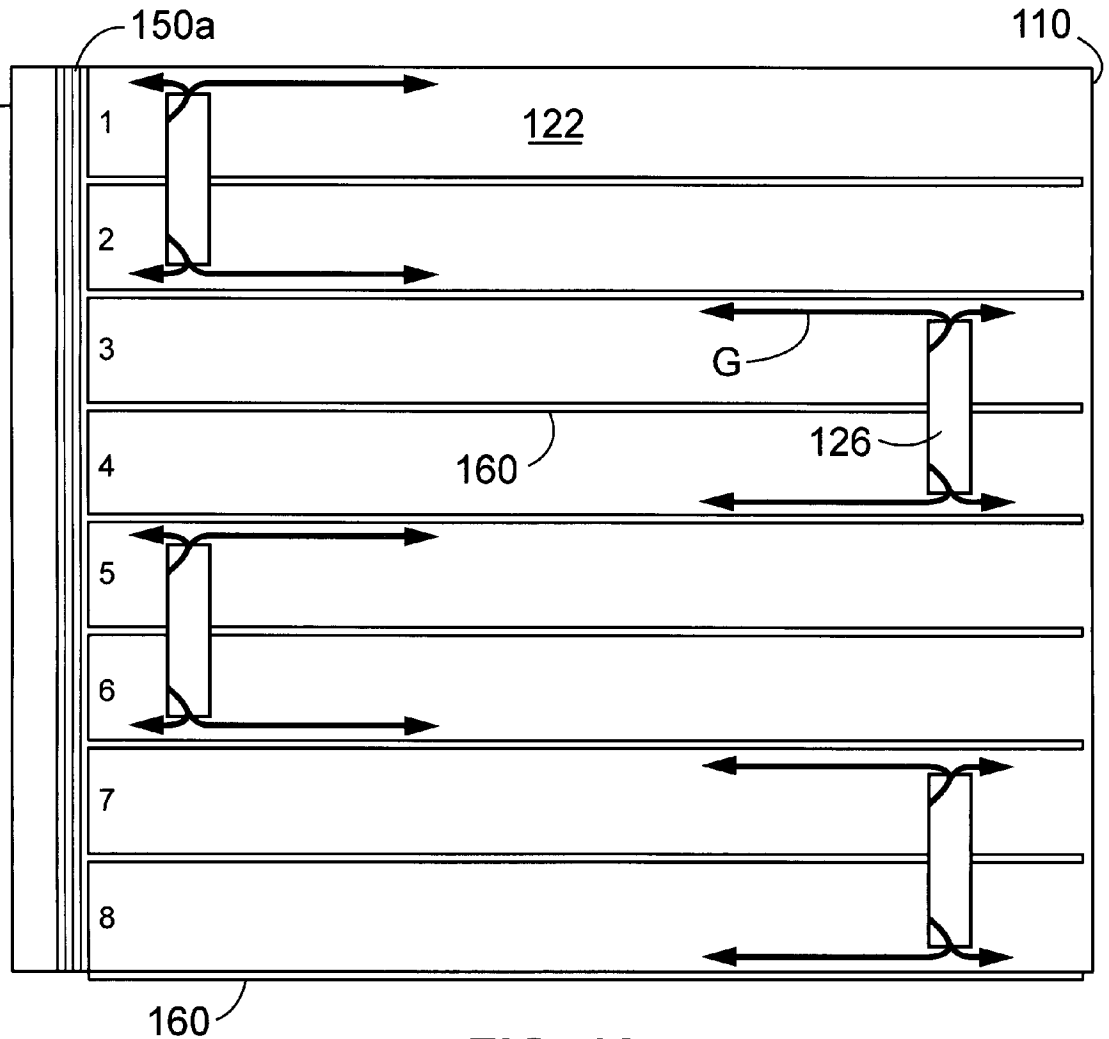
FIG. 18 is an unfolded view of the exemplary body of FIG. 17.
Figure 17:
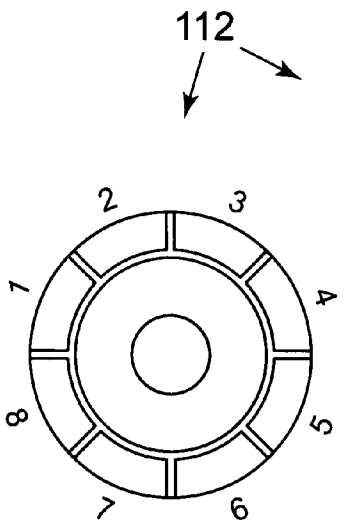
FIG. 17 is a front view of yet another exemplary body of a suppressor.

In the specific example of FIGS. 17-18, eight ribs 160 are interposed among four, rectangular-shaped, gas-transfer ports 126. Note that pairs of the gas transfer ports 126 are symmetrically opposite one another and at a constant distance from the proximal end 108 and the pairs vary circumferentially about the body 112 going towards the distal end 110. Also, please note that a gas-transfer port 126 of this example extends across a rib 160.

Figure 20:
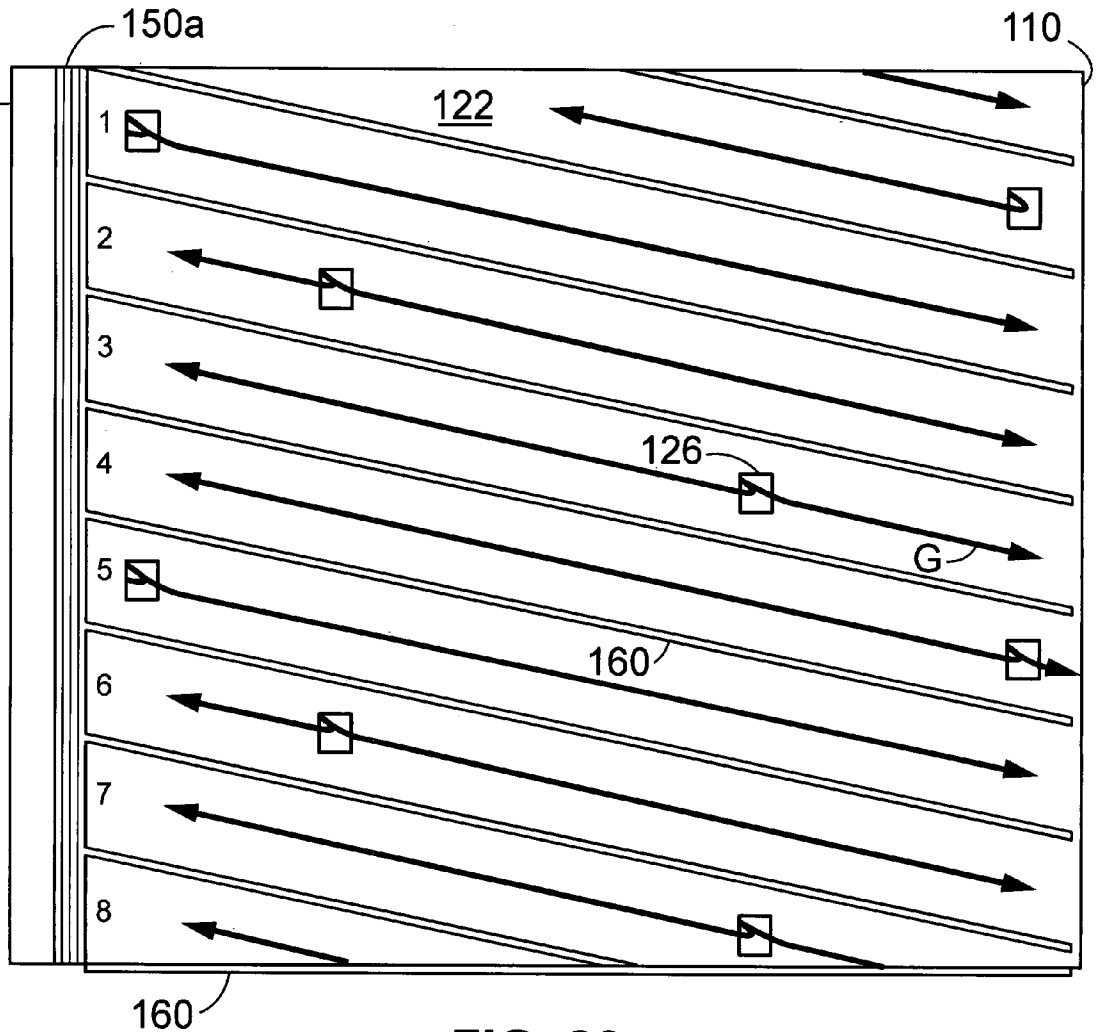
FIG. 20 is an unfolded view of the exemplary body of FIG. 19.
Figure 19:
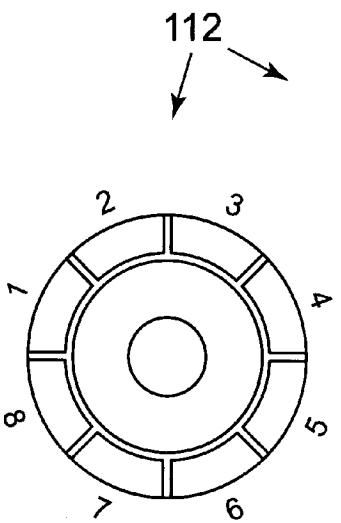
FIG. 19 is a front view of yet another exemplary body of a suppressor.
Figure 21:
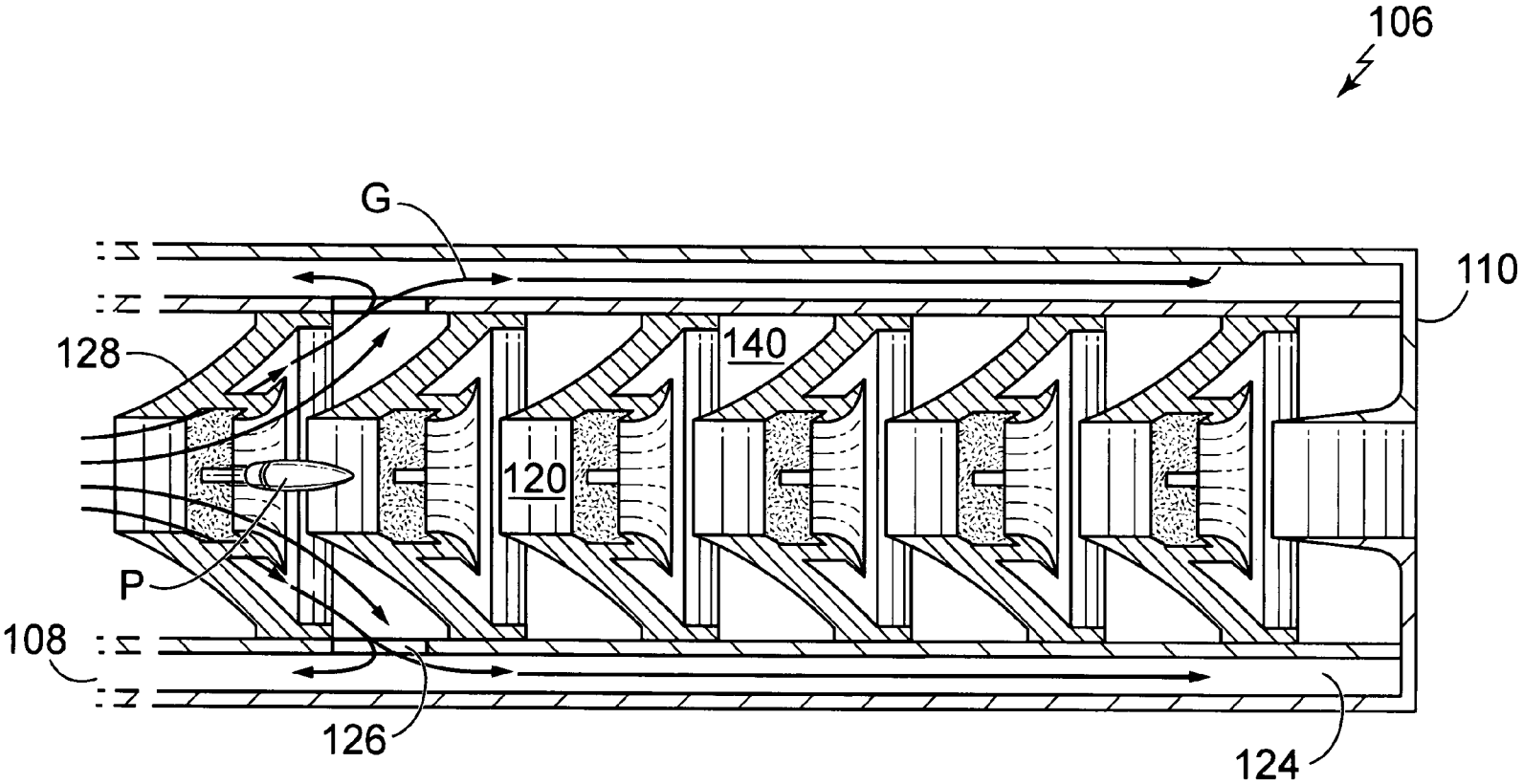
FIG. 21 is a sectional side view of a suppressor functioning in accordance with an example of the present invention.
Figure 22:
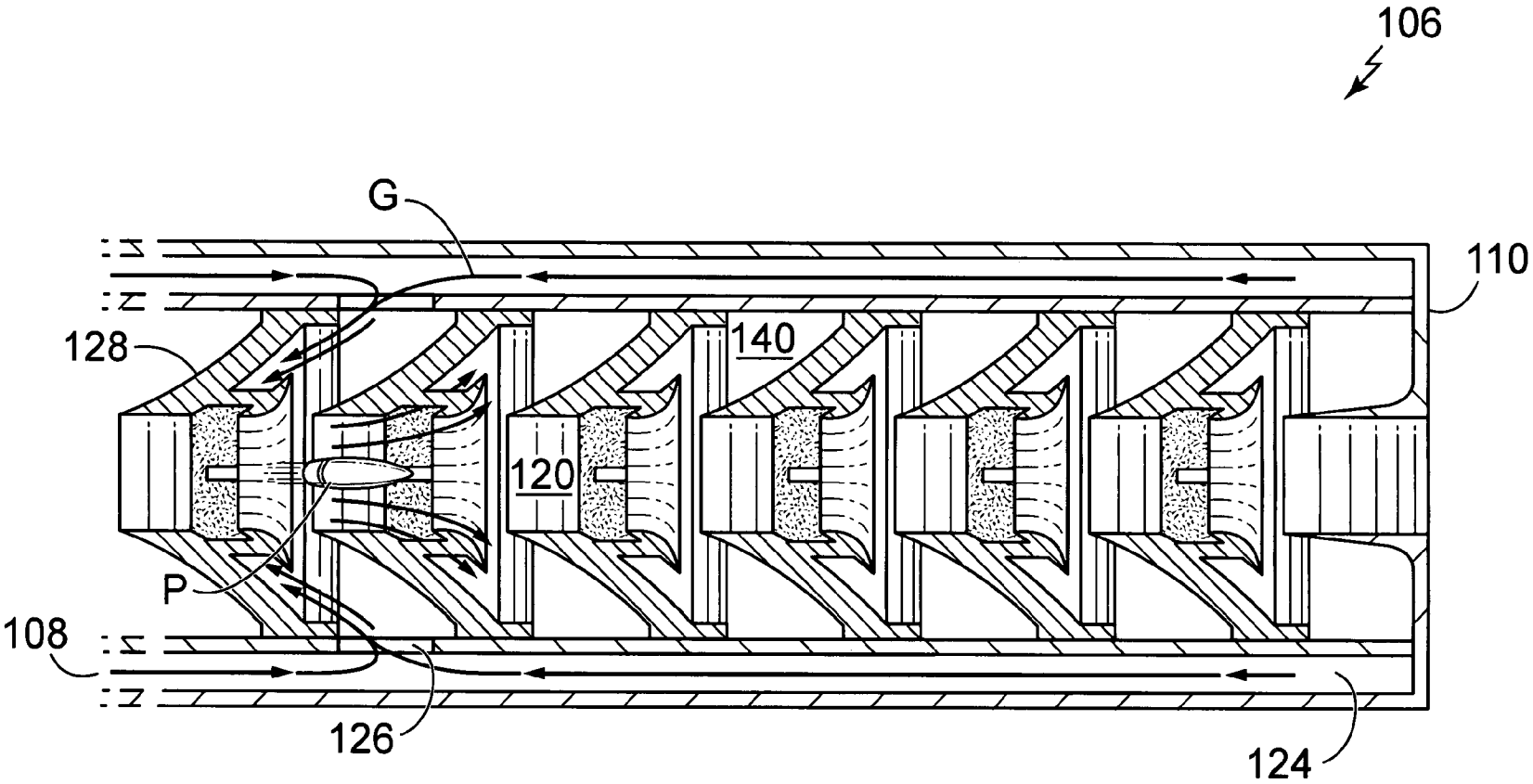
FIG. 22 is a sectional side view of a suppressor functioning in accordance with an example of the present invention.
Figure 23:
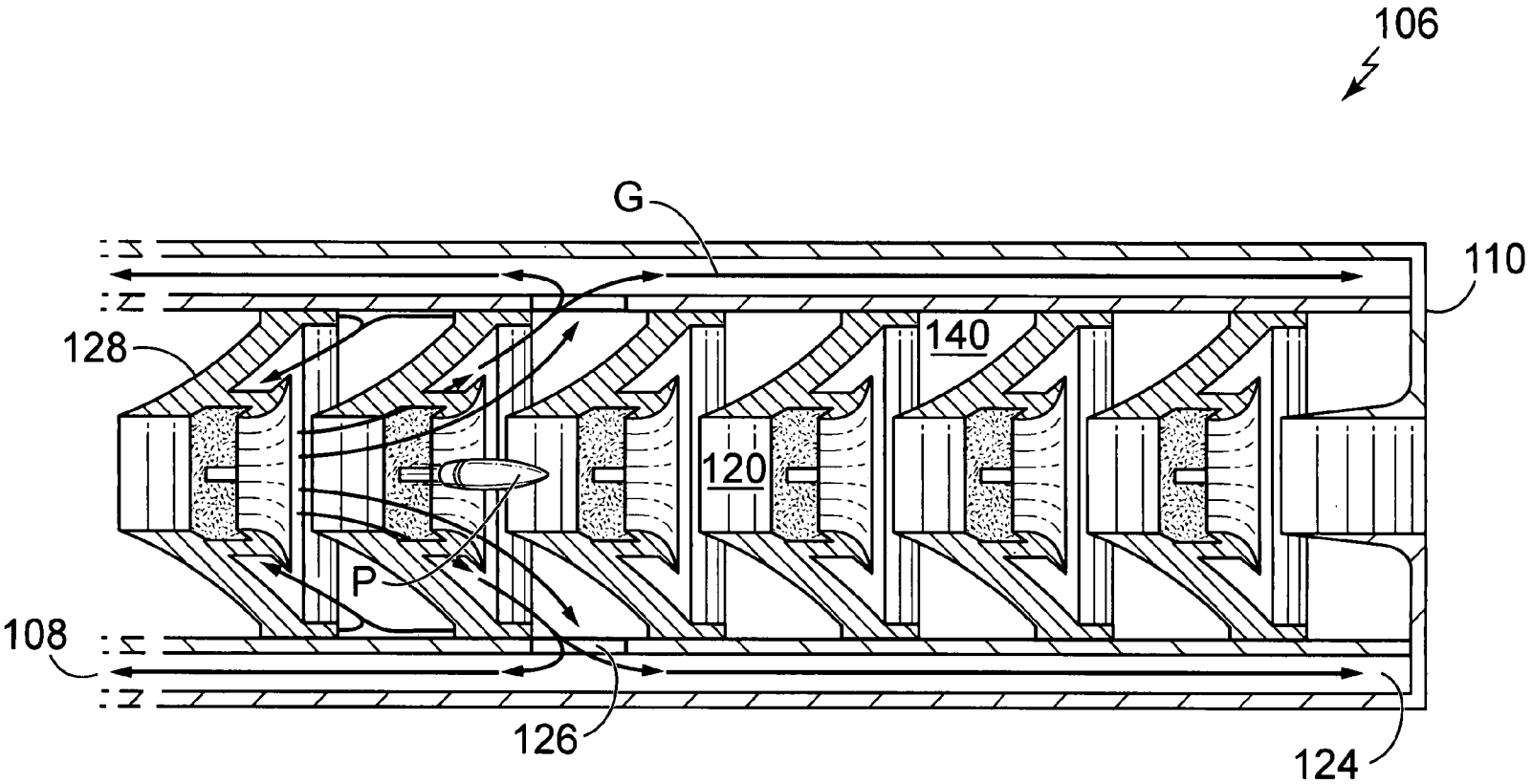
FIG. 23 is a sectional side view of a suppressor functioning in accordance with an example of the present invention.
Figure 24:
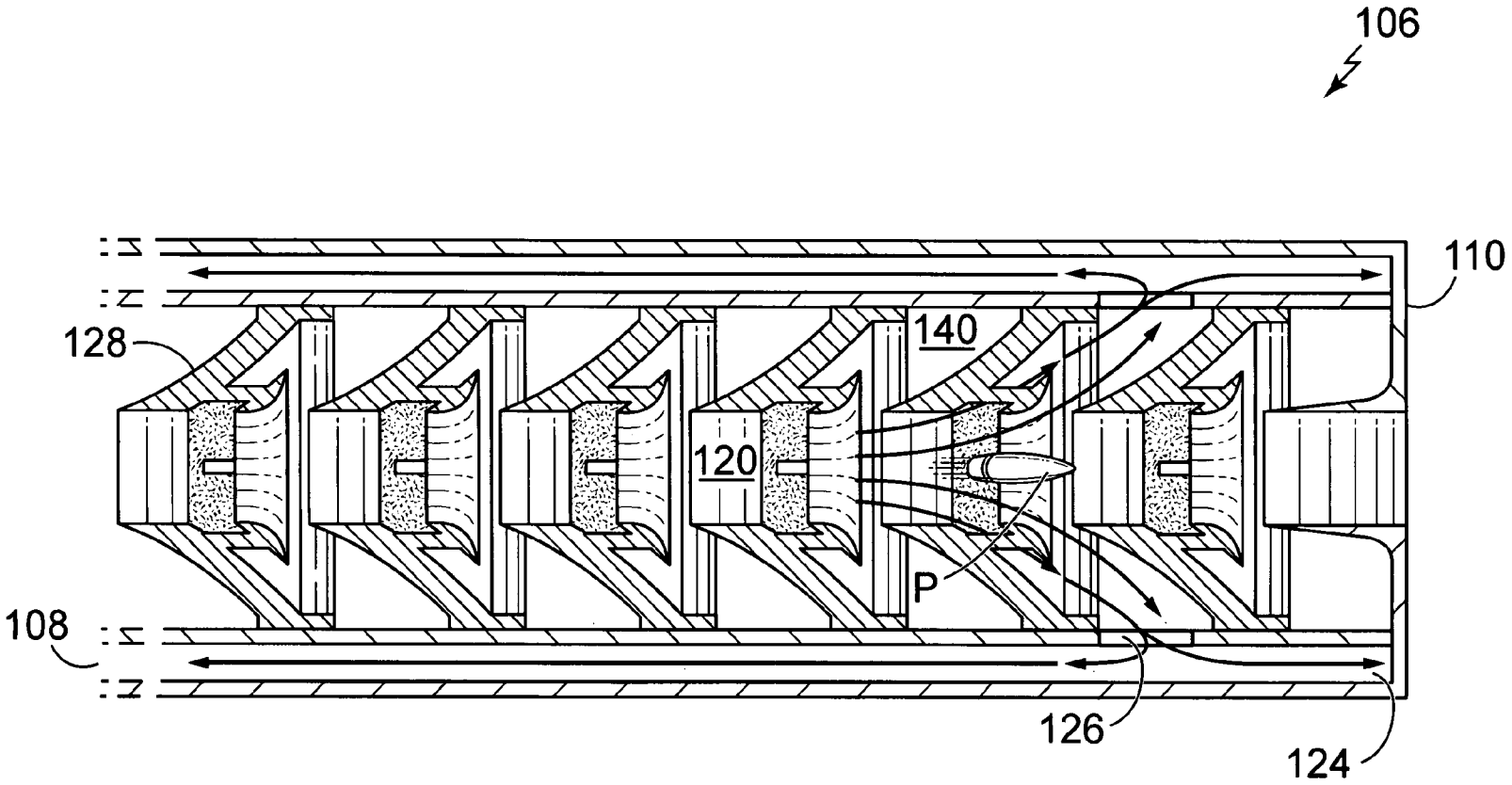
FIG. 24 is a sectional side view of a suppressor functioning in accordance with an example of the present invention.
Figure 25:
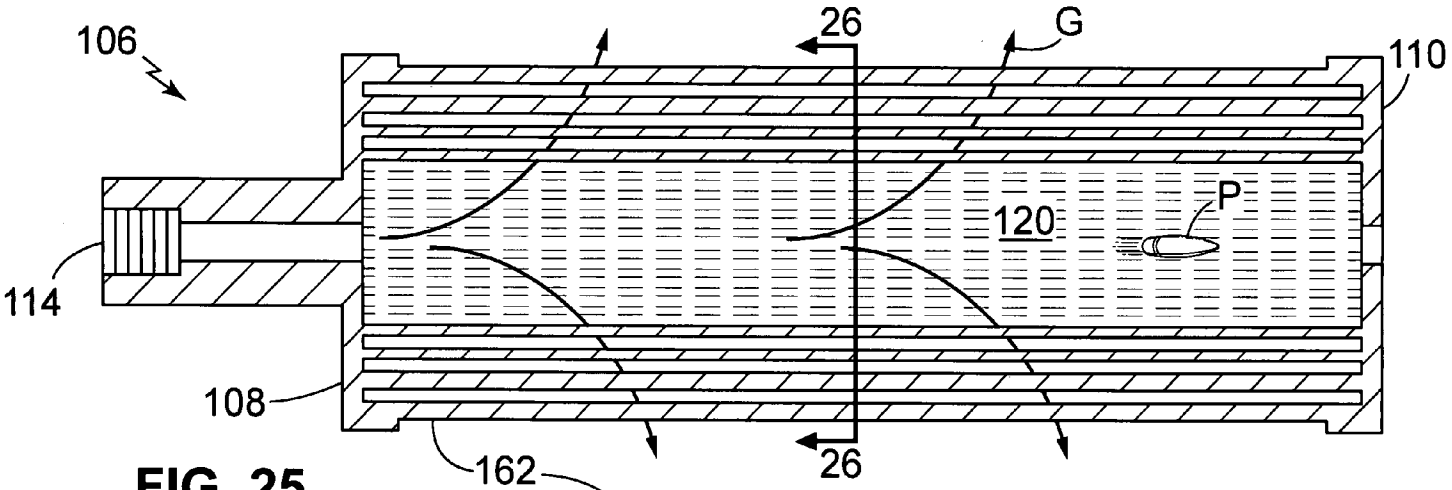
FIG. 25 is a sectional side view of a suppressor in accordance with another example of the present invention.
Figure 26:
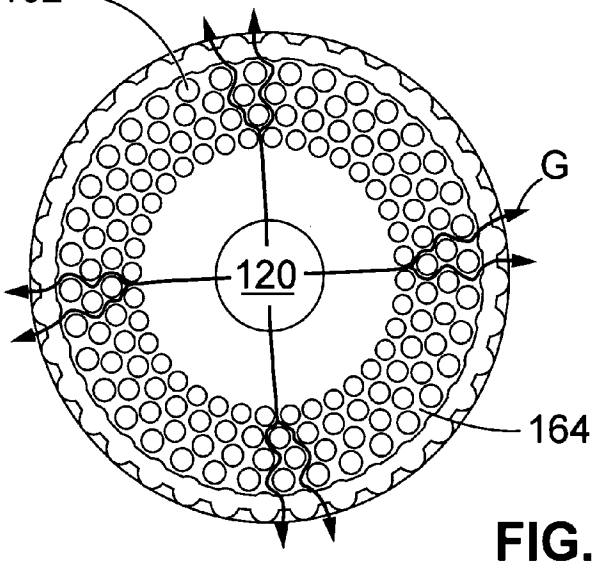
FIG. 26 is a sectional front view of the suppressor of FIG. 25 taken along line 26-26.

In the specific example of FIGS. 19-20, eight ribs 160 are interposed between eight, square-shaped, gas-transfer ports 126. Note that pairs of the gas transfer ports are symmetrically opposite one another and at a constant distance from the proximal end 108 and the pairs vary circumferentially about the body 112 going towards the distal end 110. Here, a rib 160 is at a variable distance from each of the proximal and distal ends (108, 110) in a spiral arrangement about the body 112.

Modifications to the number of ribs 160, the gas transfer port 126 number, size and location, the number and type of baffle 128, and the expansion chamber 124 volume may be necessary to optimize a suppressor 106 for a specific firearm 100 application. Overall size and weight must also be considered when optimizing the suppressor 106 to ensure the design doesn't encumber the function or handling of the firearm 100.

The operation of a suppressor 106 of the present examples will now be described in further detail with reference to FIGS. 21-24. An exemplary suppressor 106 is first attached to a muzzle end 104 of a barrel 102 via attachment means 114. After the firearm 100 is aimed and the trigger is pulled, a projectile (P) is discharged from the muzzle end 104 and into the proximal end 108 of the suppressor 106. As the projectile (P) progresses through the central chamber 120, the pressurized gases (G) are diverted outwardly from the central chamber 120 by a baffle 128, through a gas transfer port 126, and into the expansion chamber 124. The diffuser shaped surfaces 130, 132 of adjacent baffles 128 define an annular chamber 140 that directs the gases (G) through a window 146, which may substantially align with the gas transfer ports 126. Once through the gas transfer ports 126, the gases (G) then expand to fill the expansion chamber 124. The additional volume of the expansion chamber 124 reduces the pressure of the gases (G) according to Boyle's Law ($p_1V_1=p_2V_2$), and the additional travel distance increases the residence time. The increased residence time ensures a more complete burn of the explosive charge generating the gases (G), thus eliminating or reducing the blast and flash from a firearm 100. In addition, the increased residence time reduces the mass flow rate of the gases (G) exiting the device, thus extending the time frame that gases expel from the device, therefore lowering the energy rate of the expanding gases (G). This, in turn, reduces the acoustic level exiting the device and reduces noise. After filling the expansion chamber 124, the gases (G) are then directed back through the gas transfer port 126 and into the central chamber 120 at a lower velocity and pressure. This sequence is repeated at each of the gas transfer ports 126 along the length of the body 112, as the projectile (P) moves from the proximal end 108 to the distal end 110. Note that, for conciseness, the entire sequence is not illustrated in this series of figures.

With reference to FIGS. 25-28, another exemplary suppressor 106 will now be described. The suppressor 106 has a proximal end 108 for attaching the suppressor 106 to the firearm 100 (not shown). Attachment means 114 at the proximal end 108 may be internal threads (shown), a cam-lock fastener, a clamp, a set screw, or some other attachment means. Opposite the proximal end 108 is a distal end 110 where the projectile (P) exits the suppressor 106 and is directed towards the intended target.

In this example, a central chamber 120 is defined by a plurality of rods 162 extending lengthwise between the proximal and distal ends 108, 110. The rods 162 may be solid (as shown) or tubular (not shown) and are disposed in close proximity to one another around the central chamber 120. Carefully note that adjacent rods 162 do not actually touch one another. The rods 162 shown in the figures have a circular cross section, but other cross sectional shapes are contemplated. The diameters of the various circular rods 162 may be the same or may be different. In the illustrated example, the diameters of the rods 162 closest to the central chamber 120 are smaller than the diameters of the rods 162 furthest away from the central chamber 120. Concentric layers of side-by-side rods 162 extend outwardly from the central chamber 120, defining expansion passages 164 that extend away from, and about, the central chamber 120 in a tortuous path between the rods 162.

Figure 27:
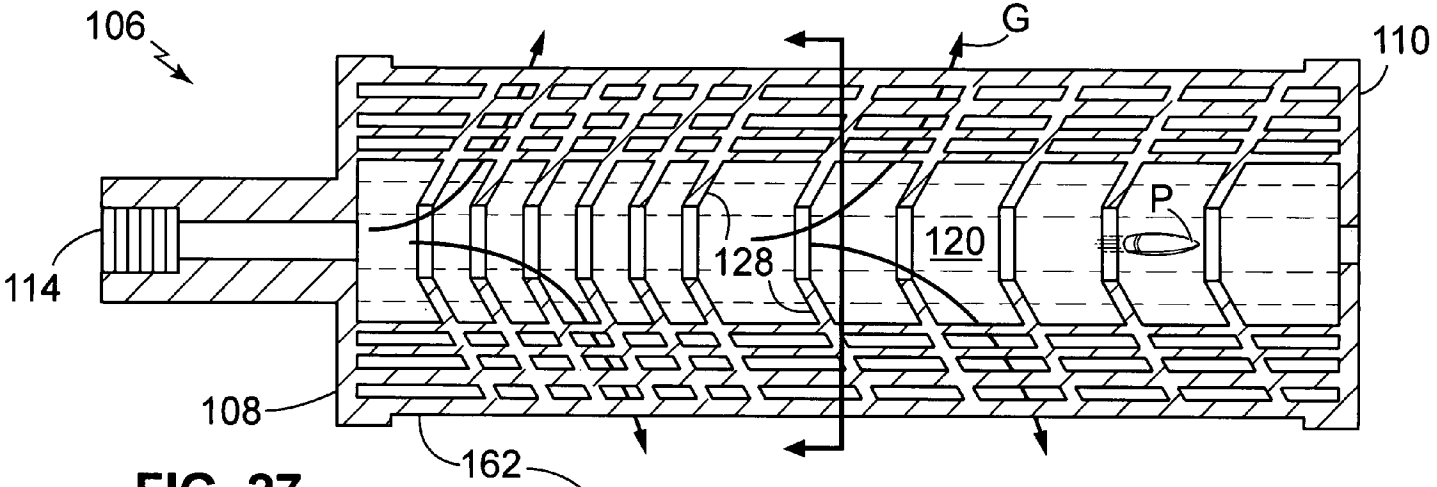
FIG. 27 is a sectional side view of the suppressor in accordance with another example of the present invention.
Figure 28:
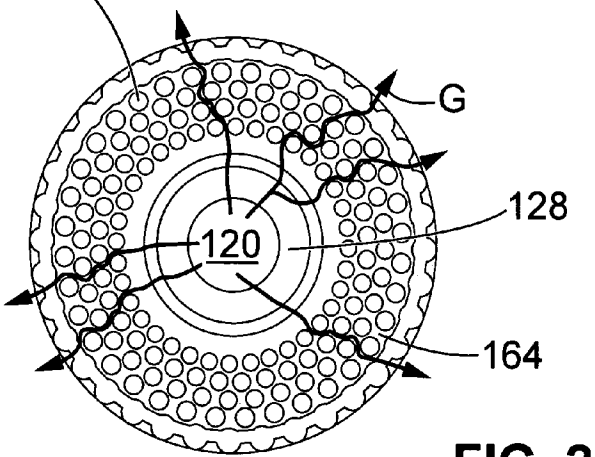
FIG. 28 is a sectional front view of the suppressor of FIG. 27 taken along line 28-28.

In some examples, a frustoconical-shaped baffle 128, having a central inlet 134 and extending outwardly from the central chamber 120, intersects the rods 162. The baffle 128 directs the gases (G) away from the central chamber 120 at the rods 162 and into the expansion passages 164. In other examples, there are multiple baffles 128 spaced apart from one another between the proximal and distal ends 108, 110. In some examples, the baffles 128 are equally spaced apart from one another and in other examples the baffles 128 are not equally spaced apart from one another. In the example of FIG. 27, the baffles 128 closest to the proximal end 108 are spaced apart from one another by a first spacing distance and the baffles 128 closest to the distal end 110 are spaced apart from one another by a second spacing distance that is greater than the first spacing distance.

The operation of a suppressor 106 of the present example will now be described in detail with reference to FIGS. 25-28. An exemplary suppressor 106 is first attached to a muzzle end 104 of a barrel 102 via attachment means 114. After the trigger is pulled, a projectile (P) is discharged from the muzzle end 104 and into the suppressor 106. As the projectile (P) progresses through the central chamber 120, the pressurized gases (G) are diverted outwardly from the central chamber 120 and impinge against the layers of rods 162. The gases (G) are then directed through the tortuous paths of the expansion passages 164 disposed between the rods 162. Note that the baffles 128 further divert the gases (G) away from the central chamber 120. The gases (G) continue away from the central chamber 120, until they discharge into the atmosphere (A) around the suppressor 106. The expansion passages 164 increase the residence time and reduce the pressure of the gases (G), thus reducing the muzzle blast and flash. If the suppressors of the present example are submerged, the water will simply flow out of the expansion passages 164.

The suppressors 106 described in the preceding examples and in other contemplated examples are preferably manufactured from an intermetallic material composition by casting, machining, and welding, and will be described in greater detail later. The suppressors 106 can also be made using a direct to metal (DTM) 3D printing process. Titanium, Aluminum, Nickel, INCONEL alloy, or other light-weight, high-strength materials may be used. Because all the elements, such as the rods 162, baffles 128, proximal end and distal end, intersect each other, the suppressor 106 is a monolithic structure and cannot be nondestructively disassembled. These examples are light weight and cost effective.

The suppressor mechanical designs described above were tested on a 5.56 caliber rifle (AR-15/M4) and a 7.62 caliber rifle (SR-251M110) and compared to conventional flash hiders and suppressors. The setup included accurate placement of microphones at 45 degrees, 90 degrees and 170 degrees (ear level) to the barrel centerline.

For the 5.56 caliber rifle test, sound pressures were compared at 45 degrees and 90 degrees to the barrel centerline. Data was recorded at 51,200 hz and acoustics were calculated for 5000 samples after triggered data. The test results are shown in Table 1 below.

TABLE 1

Figure 3:
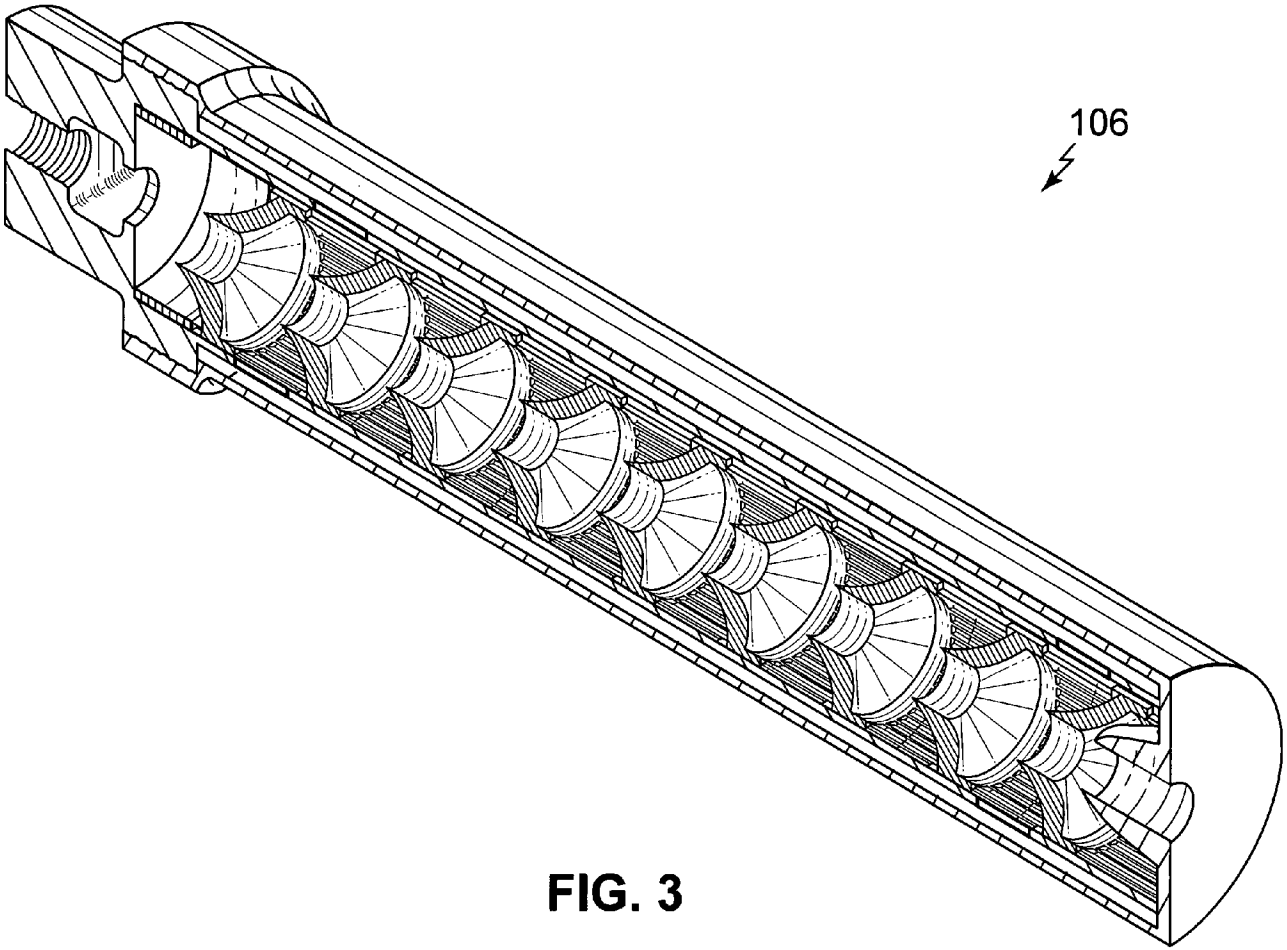
FIG. 3 is an isometric sectional view of a suppressor in accordance with an example of the present invention.
Figure 4:
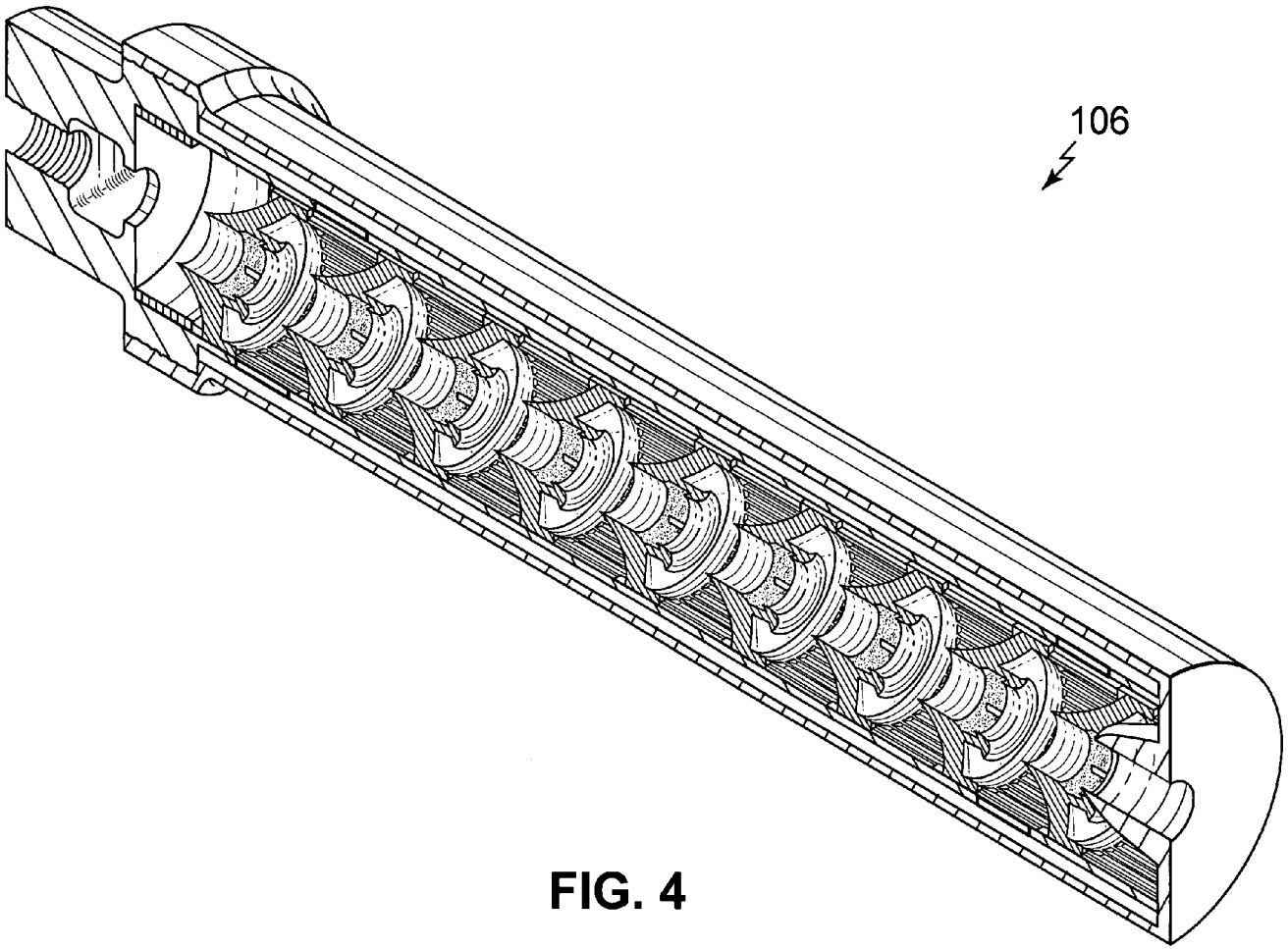
FIG. 4 is an isometric sectional view of a suppressor in accordance with another example of the present invention.

| 5.56 (AR-15/M4) Rifle | | |
|---|---|---|
| Apparatus Tested | 90 Degree [db] | 45 Degree [db] |
| Company A Flash Hider | 150.4 | 151.6 |
| Company A Suppressor | 129.8 | 140.9 |
| Company B Suppressor | 130.1 | 138.8 |
| Suppressor of Figure 3 | 129.5 | 138.3 |
| Suppressor of Figure 4 | 127.2 | 136.6 |

For the 7.62 caliber rifle test, sound pressures were measured at 45 degrees and 90 degrees to the barrel centerline. Data was recorded at 51,200 hz and acoustics were calculated for 5000 samples after triggered data. The test results are shown in Table 2 below.

TABLE 2

| 7.62 (SR-25/M110) Rifle | | |
|---|---|---|
| Apparatus Tested | 90 Degree [db] | 45 Degree [db] |
| Company A Flash Hider | 150.7 | 151.0 |
| Company A Suppressor | 132.7 | 144.1 |
| Company B Flash Hider | 151.3 | 151.5 |
| Company B Suppressor | 135.1 | 144.9 |
| Suppressor of Figure 3 | 128.7 | 140.4 |

The maximum Mach number of the gases exiting the exemplary suppressors was also calculated with CFD and compared to a commercial suppressor. The results of the Mach number tests are shown in Table 3 below.

TABLE 3

| Mach number Test Results | |
|---|---|
| Apparatus Tested | Mach Number |
| Company A Flash Hider | >5.0 |
| Company B Suppressor | >5.0 |
| Suppressor of Figure 3 | 0.56 |
| Suppressor of Figure 27 | 1.4 |

Intermetallic materials are a unique class of materials having characteristics of both metals and ceramics. They differ from conventional metal alloys in that they generally possess long-range-ordered crystal structures. The predominant bonding patterns found in ceramics are highly directional covalent and ionic bonds, whereas the unique deformation properties of metals are due to non-directional metallic bonding. Intermetallics contain both metallic and covalent bonds, depending on the constituent metals. Mixed bonding provides mechanical properties that are between metals (which are generally softer and more ductile) and ceramics (which are generally harder and more brittle).

High-temperature strength and superior oxidation resistance make intermetallic materials exceptional candidates for use in high temperature component design providing not only longer equipment service-life but the potential to operate at above normal temperatures. The high-temperature strength and superior oxidation resistance of these materials allow increases in operating temperature for suppressors.

The Department of Energy (DOE) began funding the investigation of intermetallic materials at the Oak Ridge National Laboratory (ORNL) in 1981. It has been one of the longest continuously funded materials development programs ever undertaken. Initial work focused on basic investigations of the effects of microstructure, identification of alloying elements, and the development of thermochemical and thermomechanical property databases.

ORNL identified the nickel aluminide intermetallic ($Ni_3Al$) as having unique high-temperature strength and oxidation resistance. Its highly ordered crystal structure provides increased creep and yield strengths with peak yield strength approximately 30 to 40% higher at 1475 to 1650° F. (800 to 900° C.) than at room temperature. Since nickel aluminide alloys contain up to 12 wt % excess aluminum, they form a protective aluminum oxide ($Al_2O_3$) coating which slows oxidation. It is corrosion resistant, remains strong at high temperatures and it contains no expensive or rare materials. This results in exceptional resistance to carburization and coking at high temperatures.

Despite the useful properties inherent to the $Ni_3Al$ structure, the brittle texture of the material can limit its usefulness. In addition, an intermetallic's unique structural benefits can be lost when using traditional metal fabrication techniques, particularly forming and welding. The commercialization of $Ni_3Al$ required the development of $Ni_3Al$ alloys with reduced brittleness and an increased capability for shape casting, forming and welding into useful structures such as suppressors.

ORNL is able to cast $Ni_3Al$ alloys using its Exo-Melt™ casting process for example. The reaction that produces the nickel aluminide frees a large amount of heat and is, therefore, called an exothermic reaction. This heat increases the efficiency of the process that creates nickel aluminide by dissolving the alloying metals to produce additional nickel aluminide. Machining of $Ni_3Al$ may be performed with tools comprising ceramic inserts or by electrodischarge machining for example.

By adding boron and controlling the nickel-to aluminum ratio, ORNL scientists were able to develop $Ni_3Al$ alloys exhibiting ductility at room temperature. Further chemistry modifications improved intermediate-temperature ductility and high-temperature oxidation resulting in compositions that are commercially viable.

Figure 29:
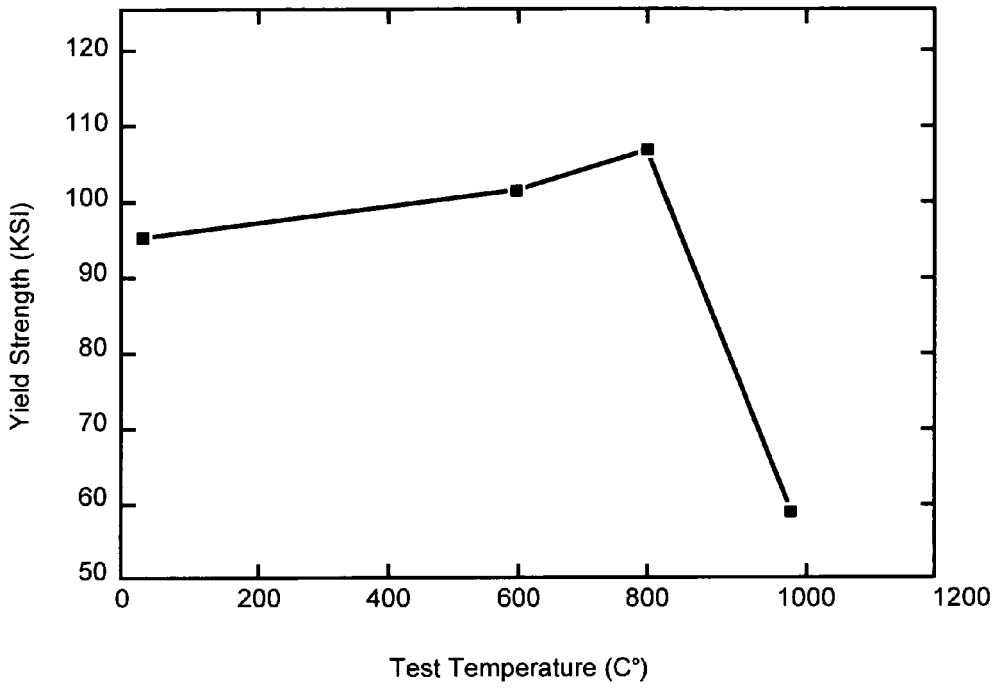
FIG. 29 is a graph illustrating the yield strength (KSI) of an intermetallic material composition at elevated temperatures.
Figure 30:
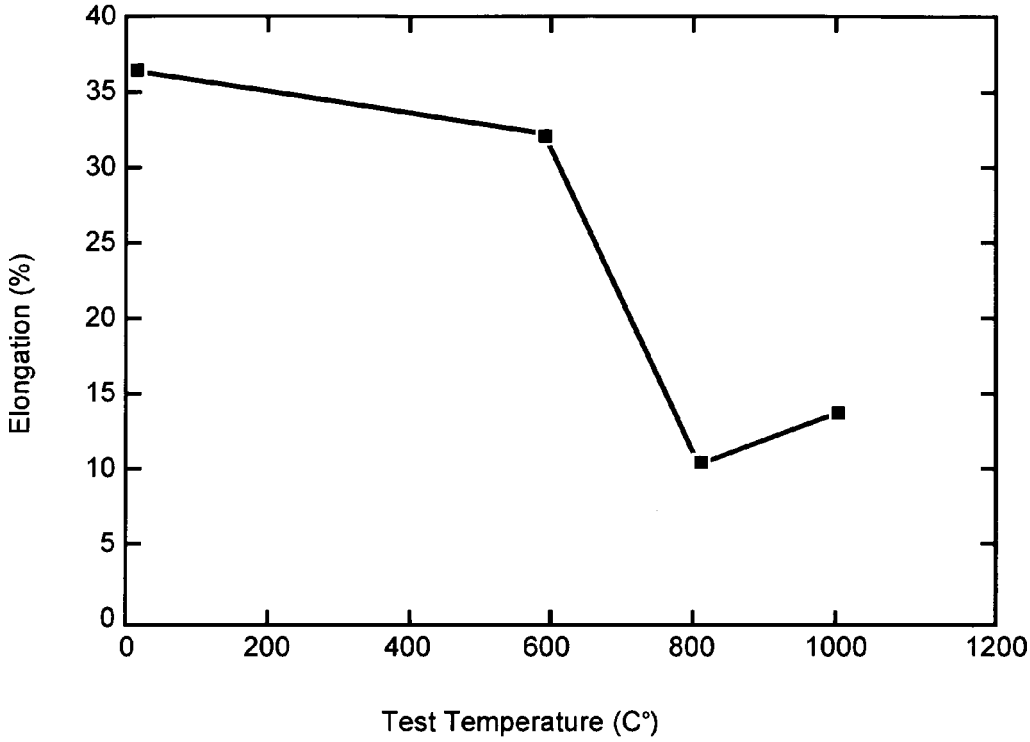
FIG. 30 is a graph illustrating the elongation (%) of an intermetallic material composition at elevated temperatures.

A recognized $Ni_3Al$ alloy for structural use at both ambient and high temperatures in hostile environments consists essentially of nickel and, in atomic percent, 15.9 aluminum, 8.0 chromium, 0.8 molybdenum, 1.0 zirconium, and 0.04 boron. FIGS. 29 and 30 illustrate the alloy's Yield Strength (KSI) and Elongation (%) respectively. Suppressors made of this intermetallic material composition possess enhanced strength and oxidation resistance at high operational temperatures, thus improving the safety and extending the life of the suppressors over known products.

Other intermetallic material compositions may also be used for this application. For example, Titanium aluminide TiAl is lightweight and oxidation resistant; however, it also has low ductility. Titanium aluminide has three major intermetallic compounds: gamma TiAl, alpha 2-$Ti_3Al$ and $TiAl_3$.Gamma TiAl has excellent mechanical properties and oxidation and corrosion resistance at elevated temperatures (over 600 degrees Celsius), which is also a benefit for this particular application.

While this disclosure describes and enables several examples of firearm suppressors made of intermetallic material compositions, other suppressor examples and applications of suppressors are also contemplated. Accordingly, the invention is intended to embrace those alternatives, modifications, equivalents, and variations as fall within the broad scope of the appended claims. The technology disclosed and claimed herein may be available for licensing in specific fields of use by the assignee of record.

What is claimed is:

1. An apparatus for suppressing the blast and flash produced as a projectile is expelled by gases from a firearm, the apparatus comprising:

a body made of an intermetallic material composition, said body having a proximal end adjacent to the firearm and an opposite, distal end, said body having a wall with an inner surface that defines a central chamber and an outer surface that defines an inner boundary of a plurality of enclosed gas expansion chambers, the wall also defines a plurality of gas-transfer ports for fluidly connecting the central chamber with the plurality of gas expansion chambers;

a plurality of baffles made of an intermetallic material composition, each of said baffles being disposed within the central chamber of said body and proximate to a gas-transfer port, each of said baffles having a diffuser-shaped surface for diverting the gases from the central chamber to the gas-transfer port and having an airfoil, the airfoil extending from the diffuser-shaped surface by a strut for further diverting the gases from the central chamber to the gas-transfer port;

a can made of an intermetallic material composition, said can being disposed around and spaced apart from said body wall, said can having a wall with an outer surface that is exposed to the ambient atmosphere, and an inner surface that defines an outer boundary of the gas expansion chambers such that the outer surface of said body wall and the inner surface of said can wall cooperate to further define the enclosed gas expansion chambers;

a plurality of ribs made of an intermetallic material composition, each of said ribs extending from said body wall outer surface to said can wall inner surface, the ribs for further defining the gas expansion chambers; and wherein the gases are directed from the central chamber to the gas expansion chambers via the gas-transfer ports as the projectile moves from the proximal end to the distal end.

2. The apparatus of claim 1 wherein the gases are directed from the gas expansion chambers back through the gas-transfer ports to the central chamber as the projectile further moves from the proximal end to the distal end of said body.

3. The apparatus of claim 1 wherein each of the gas-transfer ports is disposed between two of the ribs.

4. The apparatus of claim 1 wherein at least one of the ribs extends from said body to said can in a direction from the proximal end to the distal end of said body.

5. The apparatus of claim 1 wherein at least one of the ribs extends from said body to said can at a constant distance from each of the proximal and distal ends of said body.

6. The apparatus of claim 1 wherein at least one of the ribs extends between said body and said can at a variable distance from each of the proximal and distal ends in a spiral arrangement.

7. The apparatus of claim 1 wherein the intermetallic material composition is a Ni3Al alloy composition.

8. The apparatus of claim 7 wherein the Ni3Al alloy composition consists essentially of nickel and, in atomic percent, 15.9 aluminum, 8.0 chromium, 0.8 molybdenum, 1.0 zirconium, and 0.04 boron.

* * * * *